United States Patent [19]

Abraham

[11] 4,369,632

[45] * Jan. 25, 1983

[54] REFRIGERATED MERCHANDISER DISPLAY CASE

[75] Inventor: Fayez F. Abraham, Niles, Mich.

[73] Assignee: Tyler Refrigeration Corporation, Niles, Mich.

[ * ] Notice: The portion of the term of this patent subsequent to May 5, 1998, has been disclaimed.

[21] Appl. No.: 141,360

[22] Filed: Apr. 18, 1980

Related U.S. Application Data

[63] Continuation-in-part of Ser. No. 101,069, Dec. 7, 1979, Pat. No. 4,265,090, which is a continuation-in-part of Ser. No. 25,473, Mar. 30, 1979, Pat. No. 4,245,482, and Ser. No. 58,916, Jul. 19, 1979, Pat. No. 4,242,882.

[51] Int. Cl.[3] ..... F25D 21/12; F25D 23/02

[52] U.S. Cl. ..... 62/82; 62/282; 62/256

[58] Field of Search ..... 62/255, 256, 82, 408, 62/282, 151; 312/116, 236

[56] References Cited

U.S. PATENT DOCUMENTS

| | | | |
|---|---|---|---|
| 3,324,676 | 6/1967 | Gerweck | 62/256 |
| 3,403,525 | 10/1968 | Beckwith et al. | 62/255 |
| 3,850,003 | 11/1974 | Beckwith et al. | 62/89 X |
| 3,937,033 | 2/1976 | Beckwith et al. | 62/156 X |
| 4,265,090 | 5/1981 | Ibrahim | 62/256 X |

*Primary Examiner*—Lloyd L. King

*Attorney, Agent, or Firm*—LeBlanc, Nolan, Shur & Nies

[57] ABSTRACT

An improved refrigerated merchandiser cabinet for food products storage and displaying which is equipped with both transparent barrier doors and an air defrost system to improve the energy efficiency. The barrier doors are openable for product entry and customer usage as well as by an air defrost system which creates a gap between the barrier door and the covered access opening to permit flow-through of ambient air for use during the defrost cycle. Operation of the refrigerated cabinet with either a single or multiple air bands during a refrigeration cycle is provided for. During the defrost cycle a number of ambient air flow pattern can be employed, including the use of an auxiliary air fan. Reversal of the air band flow pattern during a defrost cycle is provided for. The method of operating the improved refrigeration display cabinet is also included.

92 Claims, 22 Drawing Figures

Fig.11
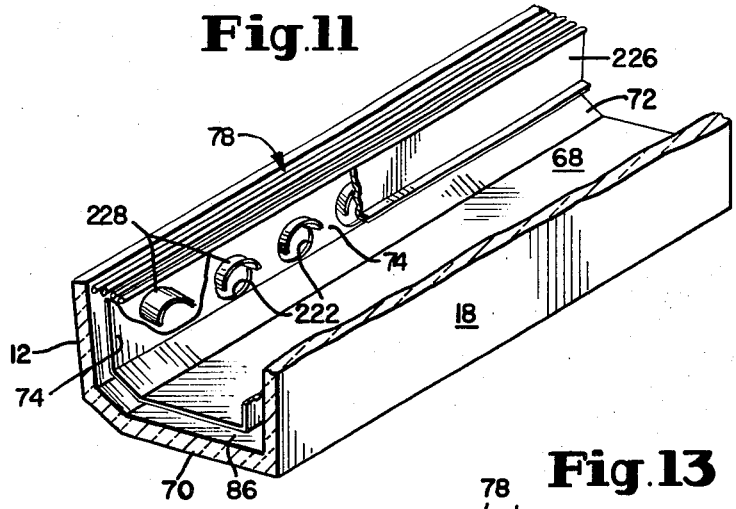
Fig.12
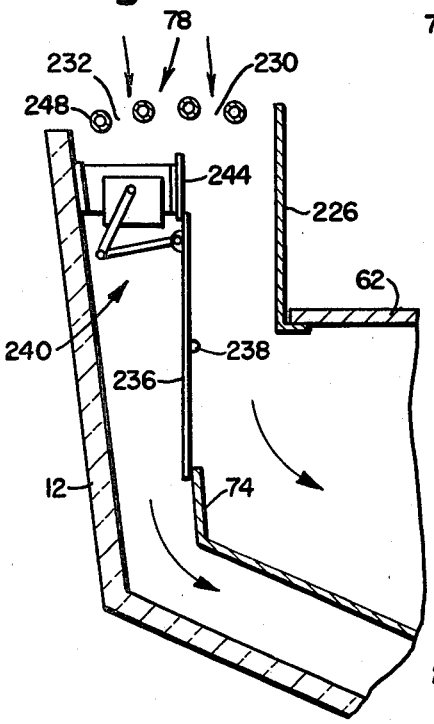
Fig.13
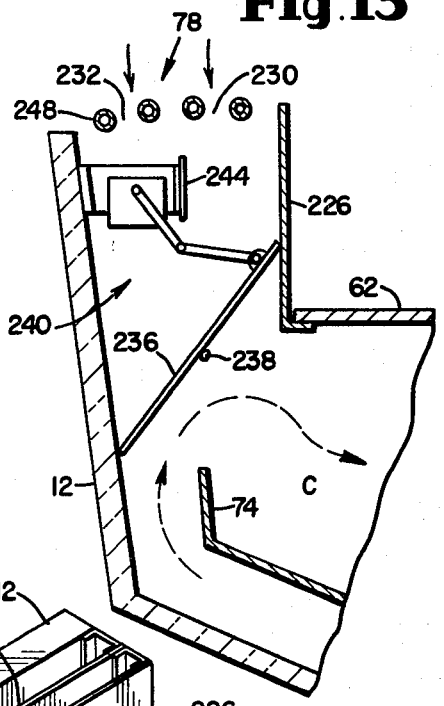
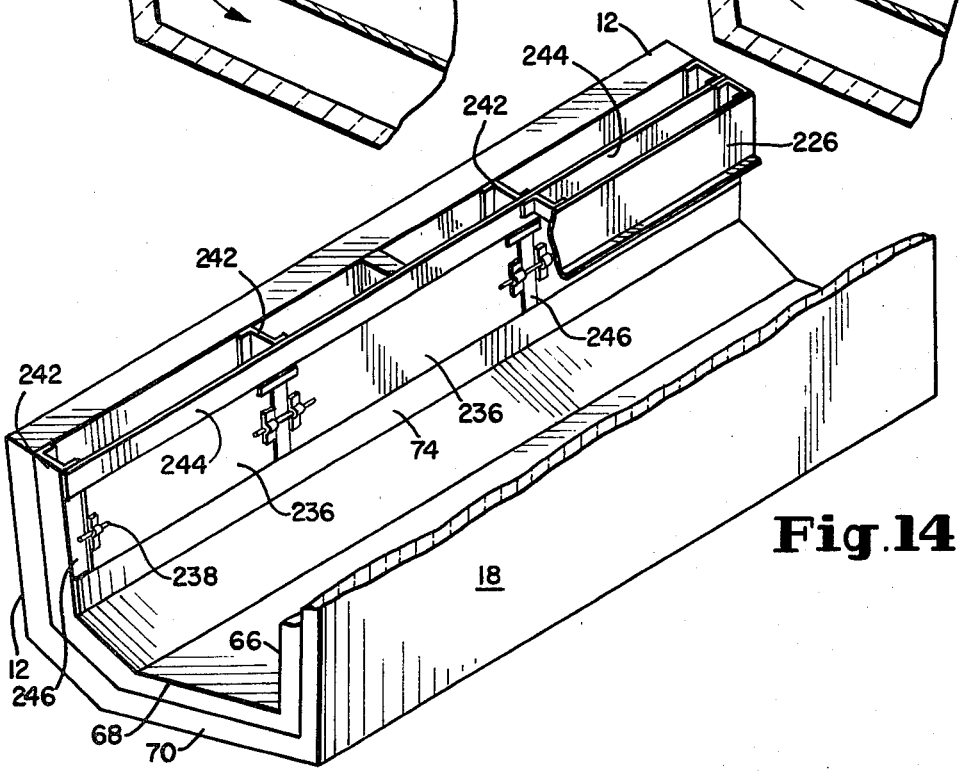
Fig.14

REFRIGERATED MERCHANDIZER DISPLAY CASE

RELATED APPLICATIONS

The present application is a continuation-in-part of application Ser. No. 101,069, filed Dec. 7, 1979, now U.S. Pat. No. 4,265,090, which application is in turn a continuation-in-part of applications Ser. No. 25,473, filed Mar. 30, 1979, now U.S. Pat. No. 4,245,482, and Ser. No. 58,916, filed July 19, 1979, now U.S. Pat. No. 4,242,882.

The present application is also related to the copending application entitled REFRIGERATED MERCHANDISER DISPLAY CASE ADAPTED FOR ENERGY CONSERVATION which has the same inventorship and assignee. The disclosures of all of these applications are hereby incorporated by reference as though fully set forth herein.

BACKGROUND OF THE INVENTION

The present invention relates to a "reach-in" merchandiser type of refrigerated display case or cabinet used primarily in retail food and supermarket outlets. The term "refrigerated", in accordance with the present invention is intended to incorporate those cases maintained at a temperature at or in excess of 32° F., such as display cases utilized for display for milk and fresh foods, and those cases maintained below 32° F., such as frozen food cases. In addition, references are made herein to the use of transparent doors, since those are the types of doors most frequently utilized in such retail outlets. Other types of doors could also be employed within the scope of the present invention.

In the operation of all types of refrigerated display cabinets, it is desirable to include a system for automatically defrosting the refrigeration coils. The defrost cycle can be actuated either at set periodic time intervals or when the frost buildup within the system has reached a certain predetermined level. Such systems are typically thermostatically controlled so as to switch from a refrigeration cycle to a defrost cycle of operation. In this manner of operation it is possible to avoid any significant frost buildup within the display cabinet such that inoperability and spoilage of food products would occur.

There have been three different approaches for defrosting refrigerated display cabinets in this art. These are, utilizing electric resistance heaters; passing a compressed refrigerant gas having a high specific heat through the refrigeration coils; and, circulating ambient air through an air conduit in which the refrigeration coils are positioned. Due to the increased cost of energy, efforts have been made to place more emphasis on the utilization of ambient air defrost systems as an alternative to the electrical resistant heaters or compressed refrigerant gas defrost systems.

This invention relates to a "reach-in" transparent door merchandiser type of refrigerated display cabinet having an air defrost system incorporated therein.

One type of system which employs ambient air during a defrost cycle is exemplified by U.S. Pat. Nos. 3,403,525; 3,850,003 and 3,937,033, all to Beckwith et al. These systems use fans separate and distinct from the main circulating fans to move ambient air across the refrigeration coils for defrosting. The additional fans are turned on only during the defrost cycle of operation for pulling ambient air from outside of the display cabinet directly into the air conduits located within the walls of the cabinet. A second type of system is illustrated in U.S. Pat. No. 3,082,612 to Beckwith, which system draws ambient air into the main circulation path through ports located in the lower front panel of the refrigerated display cabinet. Such ports are normally closed during the refrigeration cycle and opened during the defrost cycle. The Beckwith et al, U.S. Pat. No. 3,850,003 patent indicates that the concepts described in U.S. Pat. Nos. 3,082,612 and 3,403,525 did not prove to be practical and hence were not commercially feasible.

Another type of ambient air defrost system is shown in U.S. Pat. No. 4,144,720 issued to Subera, et al which is assigned to the same assignee as the present application. In the Subera patent, an open-front refrigerated display case having primary and secondary air conduits is disclosed. In this system the direction of the air flow within one of the conduits is reversed, for example, by the use of reversible fans to provide ambient air defrost. U.S. Pat. No. 4,026,121 to Aokage, et al, which illustrates an open-front display case, and U.S. Pat. No. 4,120,174 to Johnston, which illustrates an open-top display case, also disclose reverse ambient air flows for defrosting.

In those ambient air defrost systems disclosed in the above-noted patents which use a reverse air flow, during the defrost cycle of operation, ambient air can easily be drawn through the access opening of the case or cabinet into the air conduit through the outlet opening of the air conduit and then expelled from the air conduit after the defrost operation through the inlet opening and then forced out of the cabinet through the unblocked access opening. Such an arrangement, however, can not be readily used in a refrigerated merchandiser display case having barrier doors, since the front opening in the cabinet is covered by the doors. Thus, in order to employ an ambient air defrost system, a different type of system had to be conceived.

In seeking to employ ambient air defrost techniques in cases having doors, systems have been developed for drawing air over a limited portion of the air conduit by opening flaps into the conduit, which flaps are arranged so as to straddle the evaporator coils of the refrigeration mechanism. Such systems are disclosed in U.S. Pat. No. 3,226,945 to Spencer and U.S. Pat. No. 4,072,488 to Johnston. The patent to Spencer illustrates a plurality of different embodiments of open-top refrigerated display cases, both of the single shelf and multi-shelf types, in which the air flow is always drawn over evaporator coils in a single direction under negative pressure. During the refrigeration cycle of operation, air after being refrigerated is circulated through the air conduit and into the display section of the case. The patent to Johnston discloses a glass door type merchandiser display cabinet in which air is circulated through the air conduit and through the evaporator coils arranged within the air conduit in such a direction that cold air enters the display space at the bottom of the cabinet and is then drawn up into the air inlet located near the top of the cabinet. For defrosting, top flaps are opened since this case is designed with coils at the top. This shows a somewhat complicated way to provide both glass doors and air defrost features according to the prior art. Such systems are relatively complex and can involve certain operational problems, particularly due to frost and dust accumulation. Where there are moving parts inside of the air conduit an accumulation of frost on such parts can cause them to stick and hence not function properly.

The prior art as represented by the patents discussed above has treated the opening of the barrier doors on such merchandiser refrigerated cabinets as being only a problem as illustrated by Johnston, U.S. Pat. No. 4,072,488 which describes the frost buildup due to the opening of the cabinet doors.

The prior art does not appear to have viewed the opening of the doors as a possible solution to the defrosting requirements.

The background of the invention described and claimed in the present application also includes a recognition of the energy conservation trend among managers of retail food outlets to reduce operating costs wherever possible. One such area of energy conservation is to provide heat transfer constraining barrier doors across the refrigerated merchandiser display cabinets. Such barrier doors are often constructed of double or triple layer glass or other transparent materials in order to reduce the contact between the ambient air which has high heat and moisture content and the refrigerated air within the display cabinet.

During periods of high door openings frequency for shopping or stocking the case or when the store ambient heat and humidity levels are elevated the refrigerated air band which may be at a temperature as low as −15° F. is contacted by ambient air having a temperature as high as 75° F. This contact can raise the refrigeration load even above that required by multi-air band open front cases having no barrier doors. To solve this problem it is optimum to employ one or two guard air bands which can protect the inner refrigerated band against direct contact with the ambient air when the merchandiser doors are opened.

Beckwith et al U.S. Pat. No. 3,403,525 also discloses a night curtain which is to be placed over the normally open access area of a refrigerated case in order to reduce energy consumption during the "non-sales" hours, but with this arrangement no air defrost or customer entry is possible.

Vogel, U.S. Pat. No. 4,117,698 discloses a retractable night curtain for use during closed store hours during which no provision is made for customer entry.

SUMMARY OF THE INVENTION

An improvement in refrigerated cases is provided in which provision is made for one or more circulated air bands and an air defrost means which functions to selectively create a gap between a barrier door and the associated access opening to effect defrosting in a simple and low energy consumption manner.

The air defrost means also includes an air moving means for passing ambient air through the cabinet and through the gap between the door and the access opening to bring the ambient air into contact with refrigeration elements in the cabinet to remove accumulated frost therefrom and to thereafter eject the defrost ambient air from the cabinet. The gap created between the barrier door and the access opening is thus part of the flow path of the ambient air being passed through the refrigerated cabinet to effect the defrosting function.

The invention encompasses the use of such an air defrost means to selectively create a gap between the barrier door and the access opening of refrigerated display cabinets having only a single circulated, refrigerated air band propelled within an air conduit or having a plurality of circulated air bands therein of the type which are often used in food outlets without heat transfer barrier doors. When a plurality of air bands are included in the cabinet one of these will function as a guard band and can be operated only when needed due to expected or actual use conditions in the store.

It is, therefore, an object of the present invention to provide an improved ambient air defrost means for a refrigerated display cabinet having a customer access opening therein covered by a movable door which provides for low energy consumption operation.

Another object of the present invention is to provide a refrigerated display cabinet having an air defrost means which selectively creates a gap between a barrier door and the access opening covered by the door in order to provide for ambient air passage through the cabinet for defrosting purposes.

Still another object of the present invention is to provide a reach-in refrigerated merchandiser display cabinet or case utilizing an improved ambient air defrost system.

A still more specific object of the present invention is to provide a glass door merchandiser refrigerated display cabinet utilizing an improved ambient air defrost system wherein during the defrost operation ambient air is drawn into the cabinet and circulated through at least a substantial portion of the primary refrigerated air conduit and is thereafter expelled from the cabinet by utilizing an air flow path which passes through a gap created between the glass door and an access opening which is covered by the door.

Specific preferred embodiments of the invention will be described below with reference to the appended drawing figures.

BRIEF DESCRIPTION OF THE DRAWINGS

FIG. 11 is a cutaway perspective schematic view of the air flow guidance means shown in FIGS. 9 and 10;

FIG. 12 is a side sectional schematic view of a second embodiment of an air flow guidance means when positioned in a refrigeration mode of operation;

FIG. 13 is a side schematic sectional view of the air flow guidance means shown in FIG. 12 in a defrost mode of operation;

FIG. 14 is a cutaway perspective view of the air flow guidance means of the second embodiment of the air guidance means shown in FIGS. 12 and 13;

DESCRIPTION OF THE PREFERRED EMBODIMENTS

Figure 1:
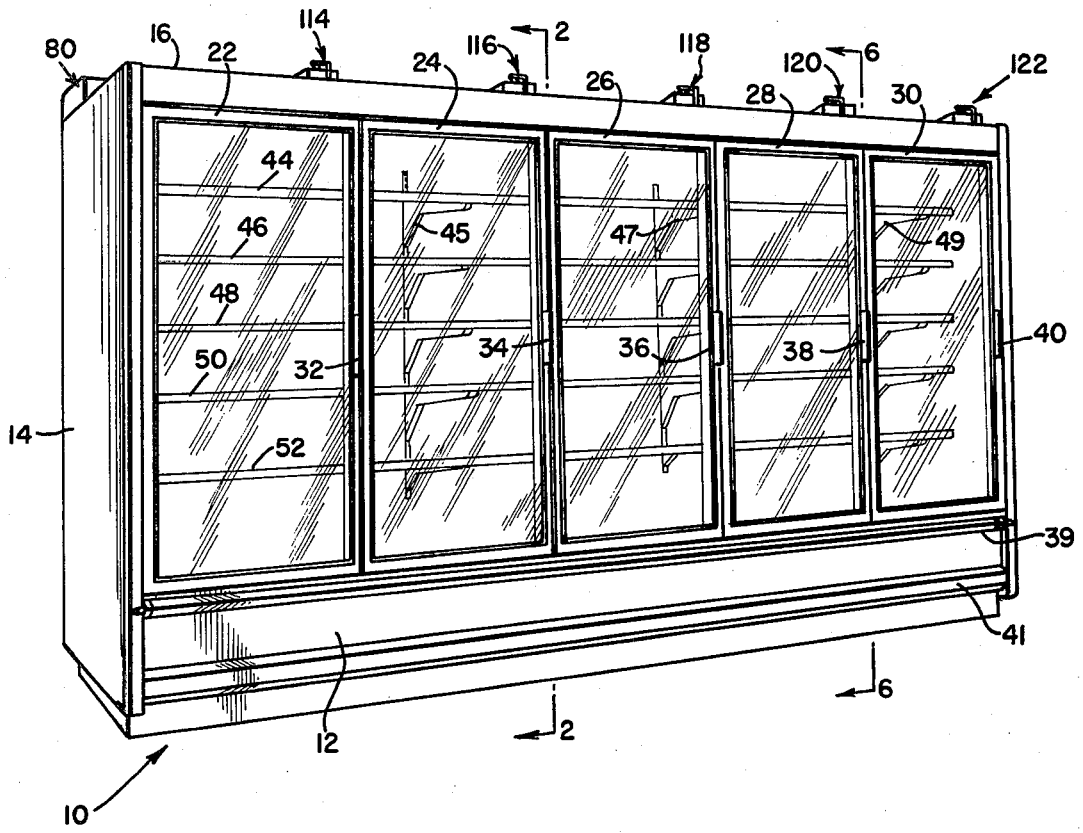
FIG. 1 is a perspective view of a reach-in merchandiser type of refrigerated display case in accordance with the present invention.
Figure 2:
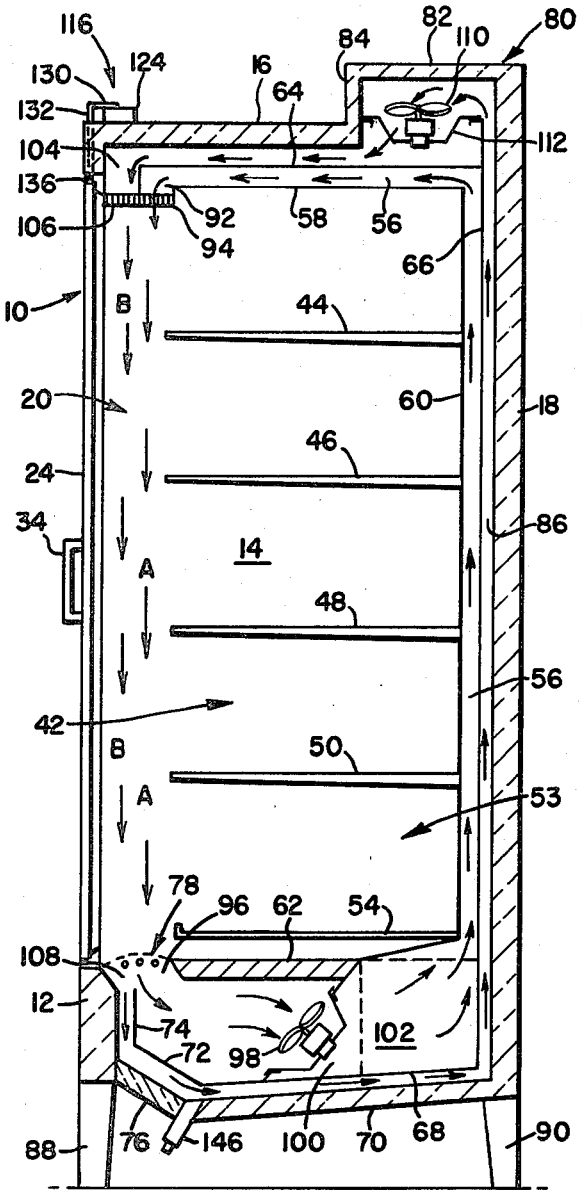
FIG. 2 is a side cross-sectional schematic view of the refrigerated display case illustrated in FIG. 1 taken on line 2—2 when such display case is operated during a refrigeration cycle.

Referring first to FIGS. 1-5 an upright refrigerated display cabinet or case assembly, generally indicated as 10, has a front wall 12, side walls 14, top wall 16 and an insulated rear wall 18, which are best shown in FIG. 2. Display case 10 has an opening 20 in its front wall 12 which is covered by one or more barrier doors illustrated by five doors 22, 24, 26, 28 and 30. Each door is attached to the display cabinet by vertical hinge pins shown as 31 in FIG. 4 and each door has a handle shown as 32, 34, 36, 38 and 40, respectively. Upper and lower bumper guard rail 39 and 41 are also provided on front wall 12. Such a refrigerated display cabinet is typically referred to as a glass-door merchandiser even though transparent material other than glass such as plastic can be used in the doors. Merchandiser refrigerated display cabinets can be used for storing either fresh foods, such as dairy products, or frozen foods requiring lower temperatures.

The interior of the display cabinet shown in FIG. 2 has a display space 42 in which there are arranged a plurality of display shelves 44, 46, 48 and 50, although more than four such shelves can be employed as illustrated by shelf 52 in FIG. 1.

Figure 3:
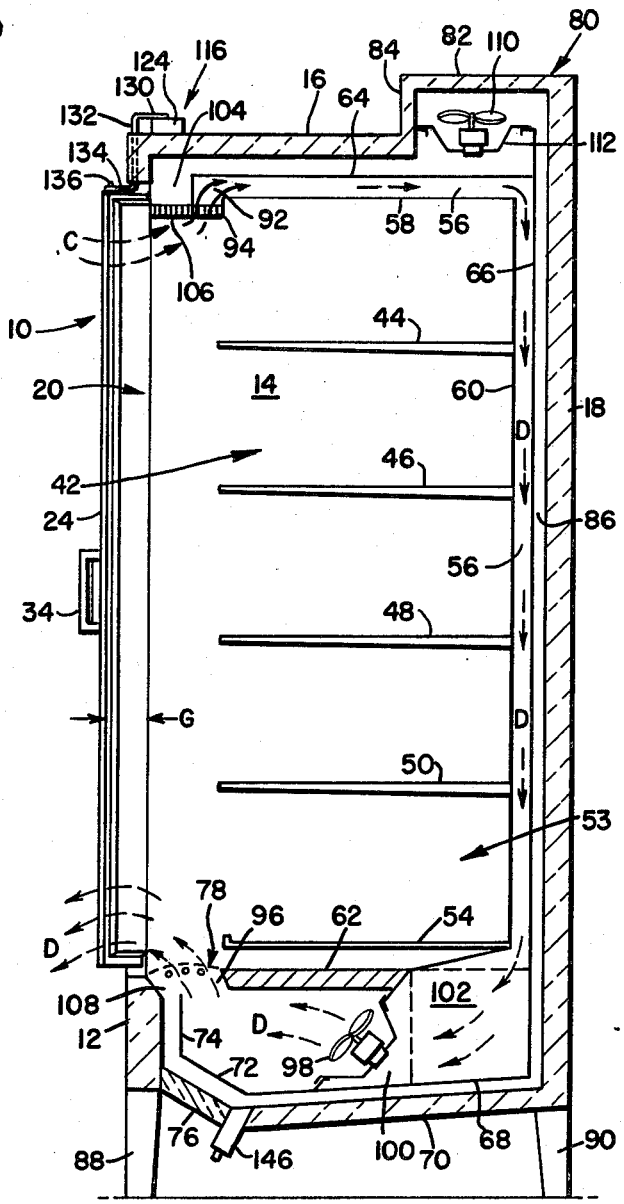
FIG. 3 is a schematic view of the refrigerated display case illustrated in FIG. 2 when such display case is operated during a defrost cycle of operation.

Each shelf can be supported by a plurality of vertically adjustable support brackets 45, 47, and 49 are shown for shelf 44 in FIG. 1. The space at the bottom of the shelves can be used as a storage space 53 and can have a shelf 54 at the bottom thereof as shown in FIGS. 2 and 3. Access to the refrigerated products on the display shelves is provided to customers and employees by opening one or more of the doors and reaching into the case through access opening 20.

Disposed about display space 42 is a primary air conduit 56 which is formed on the interior side by top panel 58 rear panel 60 and bottom display panel 62 which also form the interior surfaces of display space 42. The primary air conduit 56 is formed on the exterior side by an upper divider panel 64 which is connected along the rear edge thereof to a vertical divider panel 66 which extends downwardly and parallel to rear panel 60. Both panel 64 and 66 are shown, constructed of sheet metal although laminates of metal, plastic, and insulation can be used. Vertical divider panel 66 is connected along the lower edge thereof to bottom separator panel 68 which extends above and spaced away from bottom insulated panel 70. Bottom separator panel 68 is connected at the front edge thereof as shown in FIGS. 2 and 3 to an inclined front separator panel 72 which is, in turn, joined to a substantially vertical front divider panel 74. An inclined bottom member 76 is connected to the front edge of bottom panel 70 and is connected at its front most edge with the bottom of front wall 12 which extends upwardly and provides front support for an air grille 78 which then extends from the front wall 12 in an arcuate fashion into bottom storage space 53.

The bottom rear edge of bottom panel 70 is connected to rear wall 18. The top portion of rear wall 18 and part of top wall 16 incorporate a secondary air conduit fan housing 80 which is constructed of a top panel 82 connected along the top edge of rear panel 18 and along the front edge thereof to vertical exterior member 84 which is connected by the lower edge thereof to top panel 16. The outermost conduit formed between top wall 16 and upper divider panel 64 at the top of the cabinet and extending vertically downward between divider panel 66 and rear panel 18 forms a secondary air conduit 86 which extends between bottom separator panel 68 and bottom panel 70 in the lower portion of the cabinet. Support feet 88 and 90 are also provided for bottom wall 70.

Primary air conduit 56 terminates at its upper end in a primary conduit outlet opening 92 in which are arranged downwardly oriented directional louvers 94. At the opposite end of primary air conduit 56 an air inlet opening 96 is provided immediately below grille 78 and functions as an air intake for the primary air band indicated by arrows A. Outlet opening 92 and inlet opening 96 are thus arranged in aerodynamic alignment for the primary air band. The primary air band A is circulated by motor-driven primary fan 98 which is positioned in the bottom portion of primary conduit 56 and is supported therein by a baffle plate 100. Also positioned within conduit 56 are one or more evaporator coils of a refrigeration means indicated schematically as low temperature element 102. This refrigeration means consists of a sheet metal box in which a plurality of refrigeration evaporation coils are arranged. The sheet metal sides have openings to allow for passage of one or more air band as illustrated in the various figures by the air flow arrows and perforations. The primary air band propelled through conduit 56 by fan 98 is maintained in a refrigerated, low temperature condition during the refrigeration cycle of operation of cabinet 10.

The upper front portion of secondary air conduit 86 formed between upper separator panel 64 and top wall 16 terminates in a secondary air conduit outlet opening 104 in which are positioned downwardly oriented directional louvers 106 which function to direct the air flow downwardly across the inside of door 24 as shown by the secondary air guard band indicated by arrows B in FIG. 2. The secondary air band enters air grille 78 at the bottom portion of door 24 and then into a secondary conduit air inlet opening 108 which is associated with air grille 78. The inlet and outlet openings of the secondary air conduit are also positioned in aerodynamic alignment. This secondary air inlet opening is separated from the primary conduit inlet opening 96 by the top front portion of front divider panel 74. During the refrigeration cycle of operation shown in FIG. 2 the secondary air band B is propelled downward through the outlet opening 106 and into inlet opening 108 and then between front separator panel 72 and inclined bottom member 76 and thereafter between separator panel 68 and bottom panel 70 then upwardly in conduit 86 between vertical divider panel 66 and rear wall 18 by means of a motor-driven secondary conduit fan 110 mounted in baffle 112 positioned within fan housing 80 at the top of the case 10.

FIG. 1 shows door opening mechanisms 114, 116, 118, 120 and 122 connected on top wall 16. As will be appreciated from the later described functioning of these door opening mechanisms a single such mechanism could be arranged to operate all of the five doors shown for cabinet 10 in FIG. 1. In the specific embodiment shown in FIGS. 2 and 3 mechanism 116 is an electric motor and gear box which operates a linkage-rotating rod-lever system to open door 24.

Figure 4:
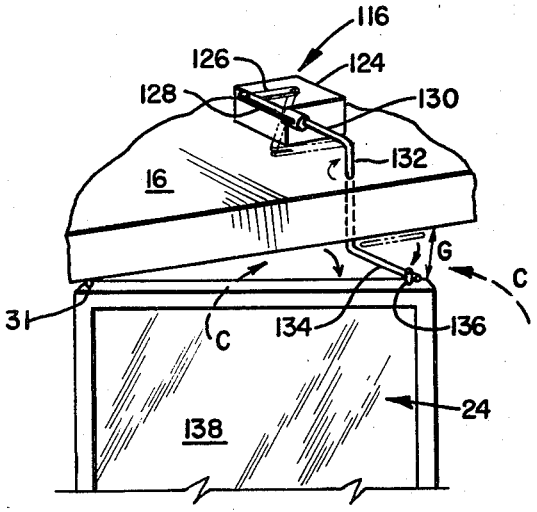
FIG. 4 is a perspective schematic view of a portion of the display case shown in FIGS. 1-3, showing a detail view of the door opening mechanism which is part of the air defrost system.

Door opening mechanism 116 is best shown in FIG. 4 wherein a electric motor and gear box 124 is mounted on top wall 16 and has a swing arm 126 attached to its output shaft. Arm 126 is pivotally linked at its opposite end to member 128 which is in turn pivotally linked to rod 130 which has a vertical portion 132 which passes through and is rotatably supported within top wall 16. The bottom of vertical portion 132 is integrally connected to an operator lever 134 which contacts stud 136 secured to the top portion of door 24 as shown in FIG. 4. When door opening mechanism 116 is activated it moves from the closed position shown in dotted lines to the open position shown in solid lines so that door 24 is opened by reason of movement of operator lever 134 against stud 136. Operation of the enclosed motor in an opposite direction causes the door opening mechanism shown to return to closed position. Springs (not shown) can be included in connection with the door hinge pins or links 126–134 to assure prompt closure of door 24 which can preferably have a substantial area of transparent material such as glass or plastic shown as 138. An alternate configuration is that operator lever 134 can be bifurcated so that it straddles stud 136 and moves door 24 positively in both the opening and the closing directions. Another configuration for the door operating mechanism is that a plurality of solenoids can operate directly against the doors to open the same or a single solenoid operating a multiple cam arrangement can open all doors or only selected doors.

Figure 5:
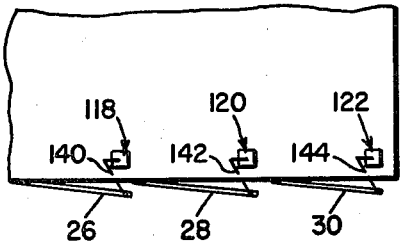
FIG. 5 is a top plan schematic view of the top right front corner portion of the display case shown in FIG. 1 which shows the door opening mechanism of the air defrost means.

Door opening mechanism 116 and the associated arms, rods and linkages provide an air defrost means for selectively creating a gap between the barrier door 24 and the access opening 20. In the defrost cycle of operation of cabinet 10 ambient air is drawn into and/or expelled out of the cabinet 10 through the gap G. This ambient air inflow is shown by dashed arrows C in FIG. 4. FIG. 5 shows three such door opening mechanisms 118, 120 and 122 and associated links 140, 142 and 144 for opening doors 26, 28 and 30, respectively.

A preferred mode of defrost operation of cabinet 10 is shown in FIG. 3 wherein door 24 has been opened by door operating mechanism 116 and ambient air (illustrated by dashed arrows C) is drawn through the upper portion of the gap G into the primary air conduit outlet opening 92 and into the primary air conduit 56 by means of the primary conduit fan 98 being operated in reverse direction from that shown in FIG. 2 for the refrigeration cycle of operation. The ambient air thus drawn into cabinet 10 is propelled through the primary conduit 56 as shown by the dashed arrows around the periphery of display space 42 downwardly in the rear portion of the primary conduit 56 and between bottom panel 62 and bottom separator panel 68 and then up to the front of the primary conduit 56. The primary air band with the entrained ambient air C is then caused to continue flowing upward and outward of cabinet 10 through the lower portion of gap G, created between door 24 and access opening 20. During this defrost cycle the warmer ambient air raises the temperature of the air flowing in the primary conduit and melts the frost and ice which has accumulated on refrigeration element 102. The secondary conduit fan 110 is not operated during this preferred defrost cycle and hence secondary air flow is dormant.

The reversed flow air system arrows have been labeled D in conduit 56 after contact with element 102 since the primary conduit air band is then a defrost ambient air band. If desired, the speed of the primary conduit fan 98 can be increased during this reverse flow and/or the pitch of the blades can be set to move a greater volume of air in the reverse, defrost direction than in the refrigeration cycle shown in FIG. 2 to provide quicker defrost. A 25% to 50% greater air flow during defrost can be achieved in this manner. The water created by this defrost action is then drained from the bottom of cabinet 10 by drain 146 which is arranged at the convergence of the downward sloping bottom panel 70 and inclined bottom member 76.

At the termination of the defrost cycle the control means operates door operating mechanism 116 to allow door 24 to close and for fan 98 to then reverse its direction to re-establish the primary, refrigerated air band A shown in FIG. 2. At the same time secondary fan 110 can be engaged for operation under one of the operating alternatives as described below.

A plurality of conduit fans illustrated by primary conduit fan 98 and the secondary conduit fan 110 shown in FIGS. 2 and 3 are spaced along the length of cabinet 10 shown in FIG. 1. For example, two each of these fans are normally provided for an eight foot long case or three each of the primary and secondary fans are provided for a twelve foot case. By way of example, but not limitation, the overall height of cabinet 10 is approximately 82 inches and the width is approximately 45 inches. Such cabinets are manufactured in lengths up to 72 feet.

MODES OF OPERATION

The operation of motor driven fans 98 and 110, refrigeration element 102, and door operating mechanism 116 is controlled by a control means which selectively operates these elements of cabinet 10 in a refrigeration cycle and then in an alternate defrost cycle. The control means receives signals from condition and time sensors and switches operation of cabinet 10 between the two cycles. The operation during the defrost cycle is controlled by an air defrost means which opens the doors and controls the air moving means, fans 98 and 110. At the termination of the defrost cycle the air defrost means controls the door operating mechanisms such as 116, 118 and 120 to close the doors and the fans 98 and 110 to revert to the refrigeration operation. The control means then takes over operations and activates the refrigeration means 102. The control means can be fabricated from conventional components, although arrangement of these components can result in several degrees of freedom in the operation of the cabinet. The control means can function during the refrigeration cycle as shown in FIG. 2 wherein air fans 98 and 110 are continuously operated and refrigerant is evaporated in low temperature element 102 as needed in order to maintain the low temperature required by products stored in display space 42. During the refrigeration cycle the door is closed as shown in FIG. 2.

An alternate mode of operation can be provided for fan 110 during the refrigeration cycle. Door switches can be provided for operation by any of the doors so that the secondary conduit fan 110 closest to the access opening covered by that door will be activated upon the opening of the door. For this purpose a switch can be installed within cabinet 10 to be operated when the door it open. Another variation is that the opening and closing of the doors by customers and employees can be used as numerical input to an electronic counting circuit so that the secondary fan 110 is operated whenever a particular frequency of openings per time period is exceeded. In this manner cabinet 10 can be provided with a control means which is responsive to the shopping demand placed on the unit. This type of sensing means to provide signals for the control means can be provided for all barrier doors or only spaced and selected doors. The sensing switches can be set so that they do not sense the defrost cycle opening of the doors by the door operating mechanisms.

Yet another variation can be the operation of secondary fan 110 depending upon the temperature and humidity conditions in the ambient store air or in the cabinet display space.

The defrost cycle of operation for cabinet 10 can be initiated by sensing the temperature at locations spaced slightly away from the coils in low temperature element 102 so that the buildup of a predetermined thickness of frost and ice on the coils will activate the sensing element which can then initiate a defrost cycle. Another means is a timer which controls the defrost cycles initiations at set intervals. Other variations are to record store ambient conditions, particularly relative humidity, and to vary the time cycle of defrost depending on such conditions. The number of openings of the cabinet doors can also be included as a control feature as above described and referenced to the operation of the secondary conduit fan 110.

The following actions occur when a defrost cycle is initiated. The refrigerant evaporation in low temperature element 102 is terminated; door operating mechanism 116 is operated to open the doors as illustrated in FIG. 5; secondary conduit fan 110 is preferably stopped; and primary conduit fan 98 is reversed so that the air flow pattern is as shown in FIG. 3, whereby ambient air enters the top portion of the gap created between the barrier door 24 and the access opening 20 and then ambient air flows through primary conduit 56 in a reverse direction in order to contact the frost and ice coated coils in low temperature element 102 and thereafter the resultant defrost ambient air is expelled from the bottom portion of the gap as shown. The defrost cycle can continue until a preset time is exceeded or a temperature measurement can be taken in the close proximity of the coils in low temperature element 102 so that the defrost cycle is terminated when that sensed point in element 102 reaches a predetermined temperature, for example 50° F., for which purpose a sensor known as a Klixon can be employed.

The door operating mechanisms 116, 118, 120, etc. can be arranged to open the cabinet barrier doors 24, 26, 28 etc. with several degrees of freedom: (1) all doors can be opened simultaneously (2) those doors having high customer demand use can be opened more frequently for defrost since the closest evaporator coils cooling the primary air band will accumulate more ice; (3) individual doors or a selected sequence such as alternate doors in the plural series of barrier doors can be opened for the defrost cycle; (4) the doors can be opened by predetermined gap distances such as 1 to 7 inches by way of preferred example or by a variable gap distance depending on the defrost condition and ice accumulation which can be used to define the ambient air intake requirement; and (5) the defrost cycle initiation and gap creation by the air defrost means including the door operating mechanisms can be controlled by the need for defrosting as determined by frost and ice buildup sensed on the low temperature element 102.

The operation of the air defrost refrigerated cabinet 10 described by FIGS. 1–22 can be carried out according to the various modes of operation disclosed above for the secondary air band flow, reversing of the primary air band flow direction, and opening of the barrier doors if these modes are not contrary to the sequence of operations disclosed herein for the various embodiments.

Figure 6:
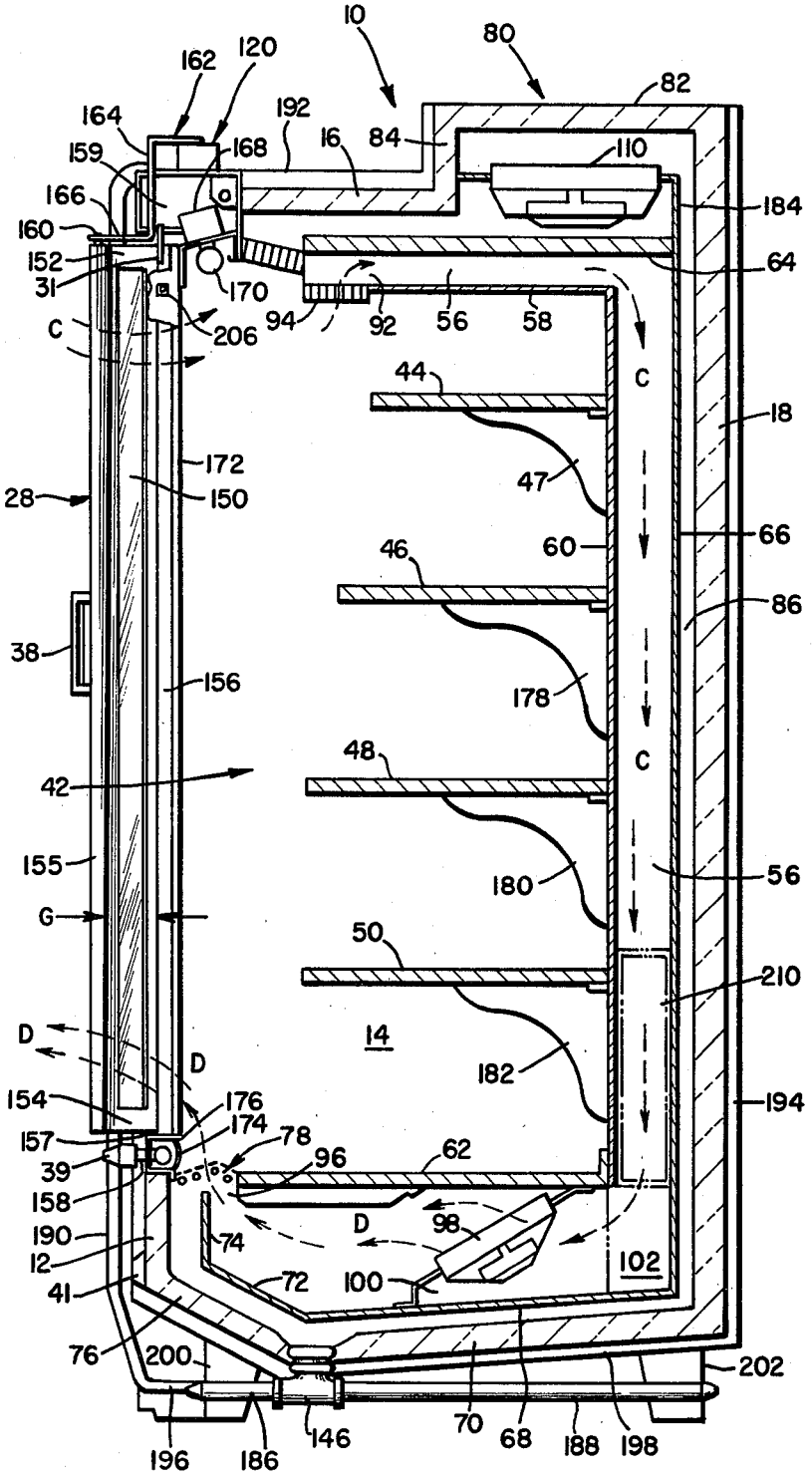
FIG. 6 is a fuller detail side cross-sectional view of the display case illustrated in FIGS. 1-3 taken on line 6—6 of FIG. 1 when such case is operated in a defrost cycle.

Additional details of the refrigerated cabinet illustrated in FIGS. 1–3 are shown in FIG. 6. Line 6—6 shown on FIG. 1 has been taken during a defrost cycle when door 28 is open. The door 28 consisting of an inside glass pane 150 and an outside pane (which is not viewable) supported by an upper frame member 152 and a lower frame member 154. The upper and lower frame members are connected by a front frame piece 155 and a rear frame piece 156. A bottom hinge pin 157 is shown for lower frame member 154 and a similar hinge pin 31 is provided for the upper frame member 152. The bottom hinge pin 157 is shown supported by the top portion of the lower light fixture bracket 158 mounted on front wall 12 and top hinge pin 31 is shown supported in top cowl 159, although intermediate door frame members can be used to provide this support. A stud 160 is secured to the top edge of door frame member 152 and this corresponds to stud 136 shown in FIG. 4. Stud 160 is secured to the frame of door 28 which is opened by door operating mechanism 120 and its associated rod and linkage mechanism 162 which is identical to mechanism 116 and associated links 128–134 described in reference to FIG. 4.

Rotatable vertical rod 164 is integrally connected at its lower end to operator lever 166. The operation of mechanism 120 causes operator rod 164 to rotate lever 166 and force door 26 open by reason of contact against stud 160.

Cabinet 10 is shown in FIG. 6 is equipped with an upper light fixture 168 which, typically, is arranged to accommodate a longitudinal series of fluorescent bulbs 170. A door frame mullion 172 is supported at its upper end by top cowl 159 and at its lower end by lower light fixture bracket 158 which is arranged to accommodate a fluorescent bulb 174 and a light guard 176 formed of a translucent material. The mullion 172 can be connected at upper and lower ends to intermediate door frame members (not shown which can also provide the hinge support for the cabinet doors). The door frame mullion 172 is one of a plurality of such mullions spaced longitudinally in access opening 20. Thus this access opening is divided into a plurality of access openings by this construction which are then covered by a plurality of doors such as shown in FIG. 1.

Shelf support bracket 47 is shown attached to the underside of shelf 44. Brackets 178, 180, and 182 can be provided for shelves 46, 48 and 50 respectively.

The insulation layer in the bottom portion of front wall 12, bottom member 76, bottom panel 70 as well as back wall 18, secondary fan housing 80 and top wall 16 can be seen proceeding around the outer wall of cabinet 10 in a counter-clockwise fashion. Also upper divider panel 64 in an insulated member. Secondary conduit fan 110 and its associated motor are shown supported by an L-shaped bracket 184 which is of different configuration than bracket 112 shown in FIGS. 2 and 3.

If desired, additional vertical fluorescent lights can be attached to vertical mullions 172 to provide additional light for display space 42.

Separator panels 68, 72 and divider panel 74 are provided in the bottom space in cabinet 10 for separating the bottom portion of primary conduit 56 from secondary conduit 86. Vertical divider panel 66 is shown separating these two conduits 56 and 86 at the back portion of cabinet 10. Suitable longitudinally spaced support members (such as spacer members 242 in FIG. 14) are provided in the construction of cabinet 10 for securing these and other described panels in the various embodiments in affixed relationship to one another.

Bottom drain 146 can be of inverted T-type configuration as shown in FIG. 6 and attached to a closable front pipe 186 and a rear pipe 188 for connection to drainage lines. An end panel trim member 190 is shown attached to the outer edges of end panel 14 at the front side thereof. A top trim member 192 is shown at the top of wall 16. Another trim member 194 is provided for the back edge of end panel 14. Bottom trim members 196 and 198 are also provided as are support feet 200 and 202. Other members such as fan 98 and support bracket 100 are shown in slightly greater detail than in FIGS. 2 and 3 above. The bumper guard rails 39 and 41 are shown at the lower portion of the front part of cabinet 10.

FIG. 6 shows the cabinet in defrost operation after door operating mechanism 120 has caused vertical rod portion 164 to rotate and cause operator lever 166 to engage stud 160. Ambient air indicated by dashed arrows C is drawn into cabinet 10 and into primary air conduit 56 and then along the rear portion of conduit 56 by primary conduit fan 98 operating in a reverse direction. The defrost air is then forced through the evaporator coils 102 and exhausted from the display space 42 through the lower portion of gap G created between door 28 and access opening 20. The air flow directions and the refrigeration and defrost positions of the various elements of the cabinet illustrated in FIG. 6 are shown by schematic FIGS. 2 and 3, above.

Also shown in FIG. 6 in the top cut-away portion is an operator switch 206 positioned against vertical door mullion 172 and designed to be contacted by the rear vertical door frame piece 156 as door 28 is opened and closed during use. This operator switch can be used to record door openings for the purpose of controlling the secondary fan 110 operation in accordance with the above described modes of operation.

Also shown in FIG. 6 is an additional set of evaporator coils 210 located adjacent to and slightly above the coil box 102.

ALTERNATIVE EMBODIMENTS

Figure 7:
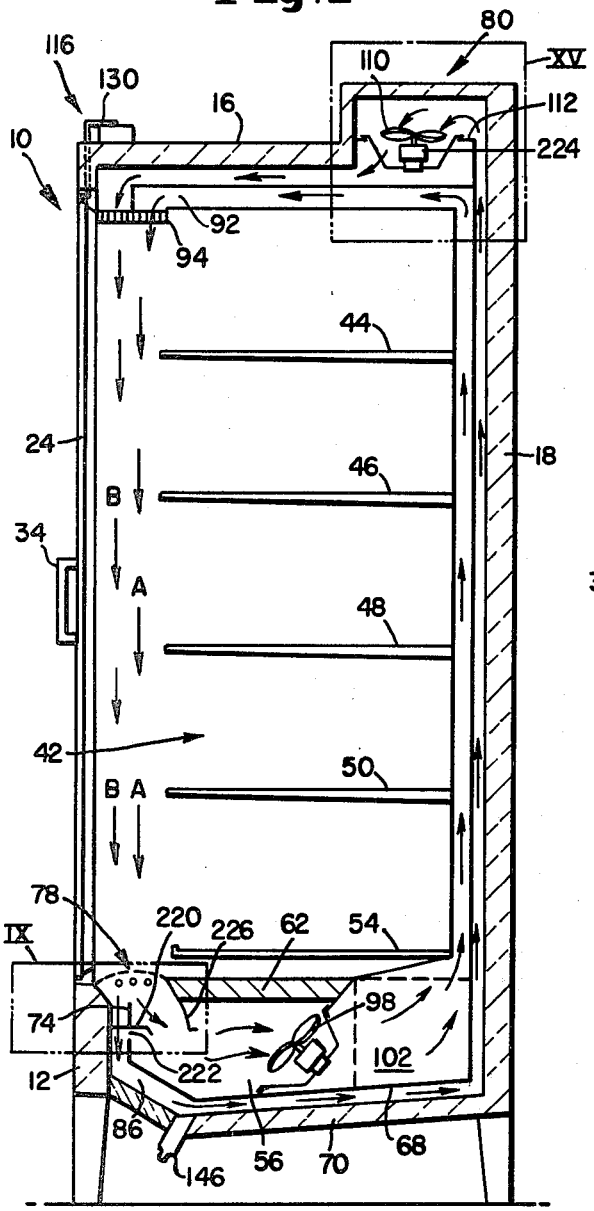
FIG. 7 is side cross-sectional schematic view of an embodiment of the present invention, shown in the refrigeration cycle, in which an air flow guidance means deflects air from the secondary conduit into the primary conduit during the defrost cycle.
Figure 8:
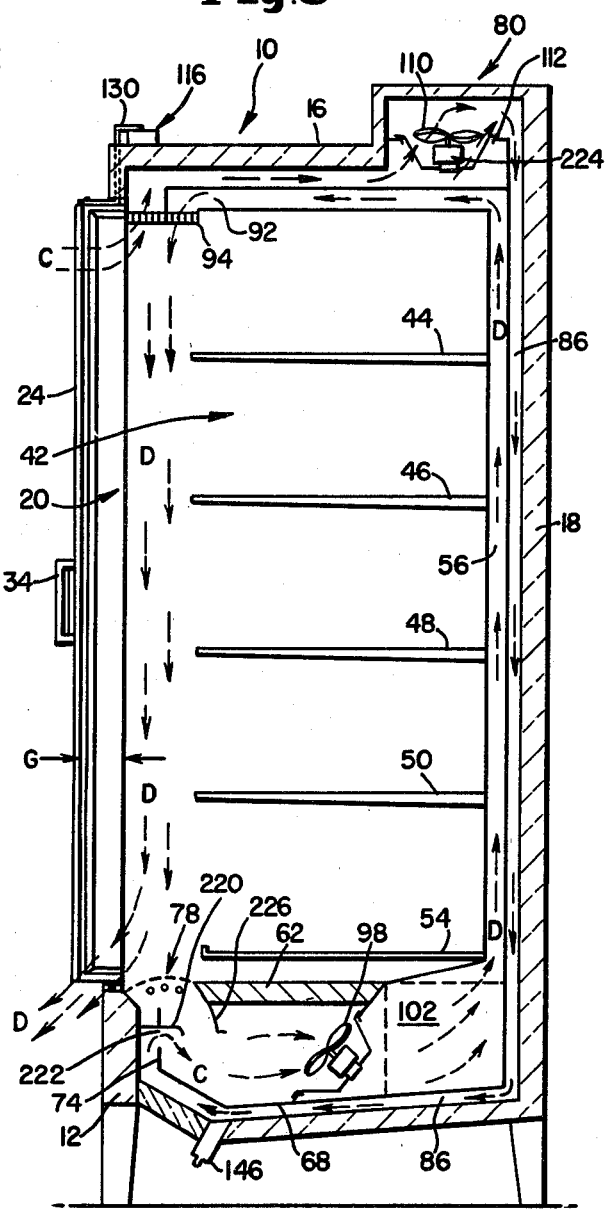
FIG. 8 shows a schematic view of the case illustrated in FIG. 7 operating in a defrost cycle with a gap created between the door and the access opening.

FIGS. 7–15 illustrate an embodiment of the present invention wherein the secondary conduit fan can be used to assist in providing for ambient air intake into the refrigerated cabinet. In this embodiment a continuous refrigerated, primary band of air is provided in order to better protect the refrigerated state of the contents stored in display space 42. FIGS. 7 and 8 show this embodiment of the refrigerated cabinet in schematic views while FIGS. 9–15 show details of the construction. Since the cabinet structure is largely the same between the first and second embodiments consistent descriptive numerals have been employed except where different or modified elements are shown.

FIGS. 7 and 8 show a cabinet similar to that shown in FIGS. 1–3 with the exception that an air guidance means is provided by deflector plate 220 located in the front divider panel 74 which separates primary air conduit 56 from secondary conduit 86. An air opening 222 is provided to allow the passage of air from conduit 86 into conduit 56 as shown by the dashed arrow labeled C in FIG. 8. In this embodiment the secondary conduit fan 110 is powered by a reversible motor 224 so that during the defrost cycle of operation shown in FIG. 8 when door 24 is opened by door operating mechanism 116 ambient air can be drawn in through the gap created between door 24 and access opening 20 as shown by dashed arrows labeled C at the top portion of FIG. 8. The secondary air band in the secondary conduit 86 then flows in a reverse direction to the direction shown during the refrigeration cycle in FIG. 7 and continues in conduit 86 under the bottom separator panel 68 and then encounters deflector plate 220 which diverts a portion of the secondary defrost air band as shown by dashed arrow C into the primary conduit 56 and the resulting mixed primary and secondary ambient air is then forced by fan 98 through low temperature element 102 and then upwardly through primary conduit 56 at which point the ambient air has been somewhat reduced in temperature by contact with the ice and frost coating the coils in element 102. This defrost ambient air is then propelled out of primary outlet 92 at the top of cabinet 10. This defrost air band then moves vertically downward as shown by arrows D and a portion of the air band is expelled from the bottom portion of gap G created between door 24 and access opening 20. The expelled defrost air volume is equivalent to the intake ambient air volume. The blade pitch and motor speed for fan 110 can be controlled to deliver a greater air flow during defrost to reduce the time required for de-icing. A 25% to 50% greater flow can be used for the defrost cycle. In this manner both fans function to draw in ambient air and defrost low temperature element 102 without the need for additional energy input by way of heating rods or compressed refrigerant gas loops which have been employed in the prior art.

As briefly mentioned above, the embodiment of this invention illustrated in FIGS. 7 and 8 also provides the advantage of protecting the stored content with a band of air at all times even during defrost whereas the embodiment shown in FIG. 3 interrupts the counterclockwise motion of the primary air band A as shown in FIGS. 2 and 7. This continual air band provides additional protection against thawing and possible spoilage for the stored food product even though the refrigerant liquid is not evaporated in element 102.

Figure 9:
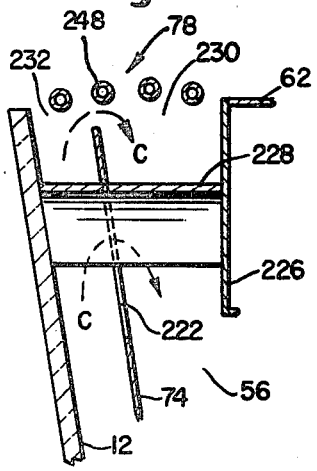
FIG. 9 is an enlarged side cross-sectional view showing the air flow guidance means in Block IX in FIG. 7 in fuller detail.
Figure 10:
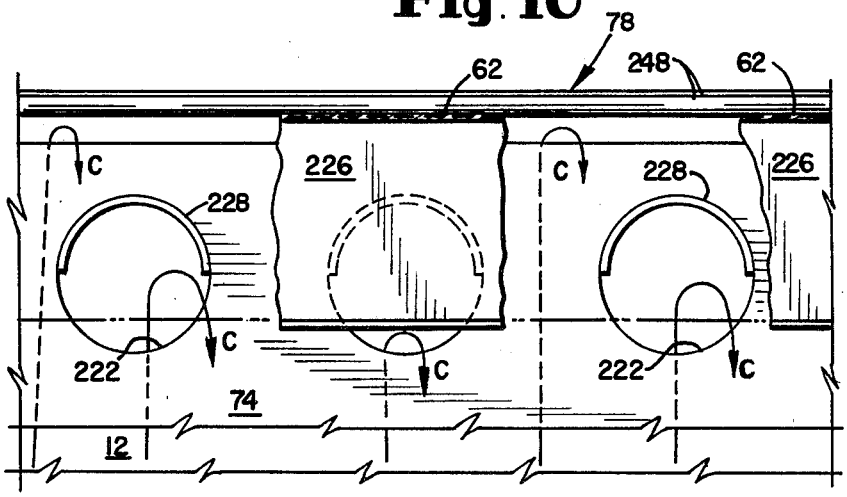
FIG. 10 is a cutaway schematic view of the inside front of a refrigerated case illustrating the air flow guidance means shown in FIG. 9.

Deflector plate 220 does not extend across the entire length of front divider panel 74. An interior front bottom panel 226 can be provided for channeling the primary air band flow and does extend across the entire length of the cabinet. As shown in FIGS. 9–11 the deflector plate 220 is preferably provided in the form of a plurality of cover plates 228 which have arcuate cross-sections and extend traversely on either side of front divider panel 74 substantially across each of the air conduits 56 and 86 and thus partially underlie the upper part of associated air grille 78. The cover plates 228 are secured on the front edge thereof to outer cabinet front wall 12 and on their inner edges to bottom front interior panel 226 which is a downward extension of bottom display panel 62. Interior front bottom panel 226 thus forms the front inner surface of the primary air conduit inlet opening 230 as best shown in FIG. 9. The secondary conduit inlet 232 is also shown as formed by the upper portion of panel 74 and front wall 12. At this reversal position the secondary air band containing ambient air, C, is then propelled under positive pressure by secondary conduit fan 110 and then by positive pressure from fan 98 through the low temperature element 102 and then upwardly through the primary air conduit 56 and hence downwardly through the primary outlet opening 92 and through downwardly directed louvers 94. The defrost air band is then ejected from cabinet 10 through the lower portion of gap G created by the opening of door 24 away from access opening 20.

The construction of an air guidance means as shown in FIGS. 9–11 for deflecting at least a portion of the reversed flow secondary air band into the primary air conduit is substantially similar to that shown in U.S. Pat. No. 4,144,720 to Subera, and assigned to the same assignee as is the present application.

Referring now to FIGS. 12–14 a second embodiment of the air flow guidance means illustrated in FIGS. 9–11 is shown. The arcuate cross-section cover plates 228 are replaced by a baffle plate 236 which is provided with a pivot pin 238 at its center. In this embodiment front divider panel 74 is terminated at a lower position as shown in FIGS. 9–11 in order to contact the lower edge portion of baffle plate 236 as it is pivoted into open position by a motor and articulated arm mechanism 240 as shown in FIG. 12 in the refrigeration cycle or mode of operation.

Baffle plate 236 is then moved to the position shown in FIG. 13 during the defrost cycle of operation in order to substantially block off the reverse flow of the secondary air band in order to force the secondary air band co-mingled with ambient air C through the evaporator coils in element 102. FIG. 14 shows the baffle plates 236 in the refrigeration cycle position and also shows interior longitudinally arranged spacer members 242 which support an upper conduit divider panel 244. Supports 246 which are extensions of inclined divider panel 74 are provided for pivot pins 238.

Both arcuate-shaped cover plates 228 and pivotable baffle plates 236 and the associated structural members function as air band diverters in order to provide an air flow guidance means to communicate the secondary air conduit 86 with the primary air conduit 56 in order to guide the secondary air band having co-mingled ambient air therein across the evaporator coils of the refrigeration means in order to defrost the same in the defrost mode or cycle of operation.

If desired air grille 78 can be constructed in part by tubes 248 which contain circulate hot refrigerant drawn from the compressor prior to the evaporator stage.

Figure 15:
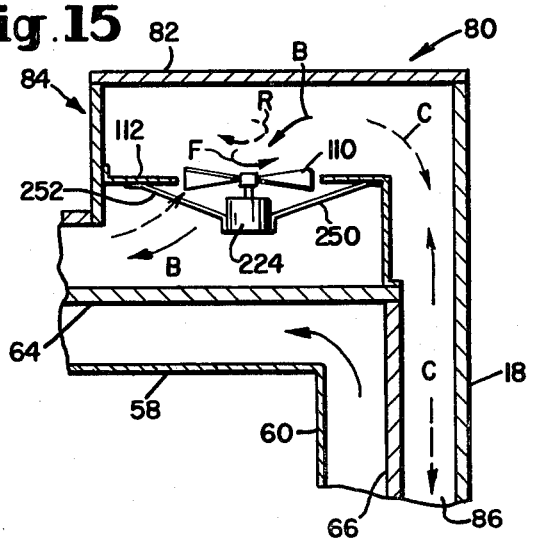
FIG. 15 is a enlarged side sectional view of block XV of FIG. 7 showing details of the operation of the two directional secondary air conduit fan.

FIG. 15 shows the refrigeration cycle direction of operation of the secondary conduit fan 110 by the solid arrow F. The defrost cycle of operation of fan 110 in the reverse direction is indicated by the dashed arrow labeled R. The secondary air band flow in refrigeration cycle is labeled B and shown by solid arrows and the air flow during defrost cycle is labeled C and shown by dashed arrows. Fan 110 is shown attached to and propelled by reversible motor 224 which is supported on L-shaped bracket 112 by supports 250 and 252.

Figure 16:
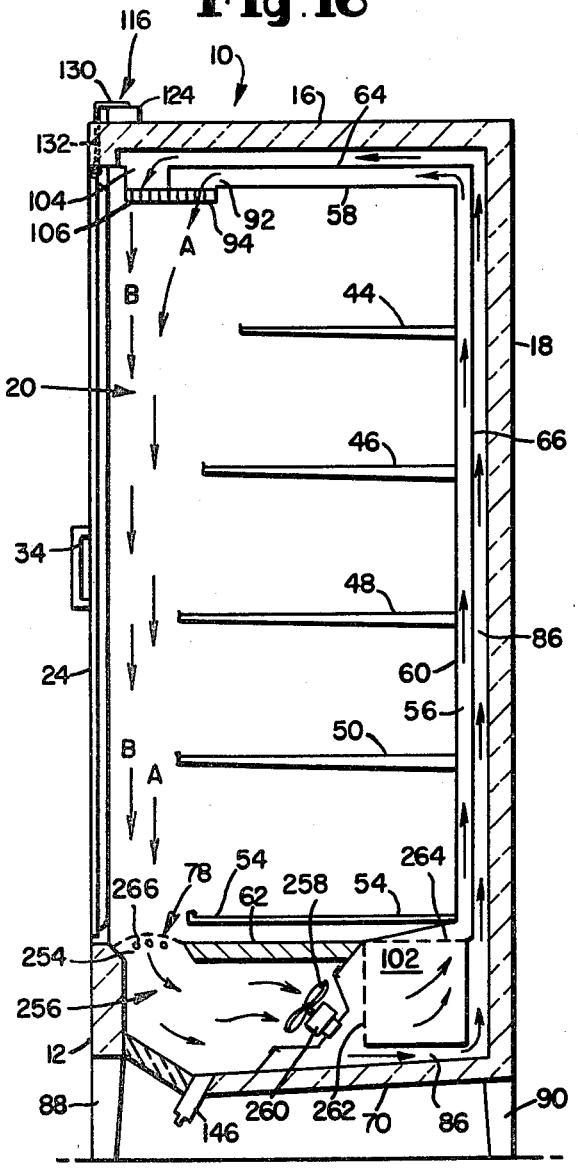
FIG. 16 is a side cross-sectional schematic view of another embodiment of the present invention having a common inlet chamber for both primary and secondary conduits, shown in a refrigeration cycle.
Figure 17:
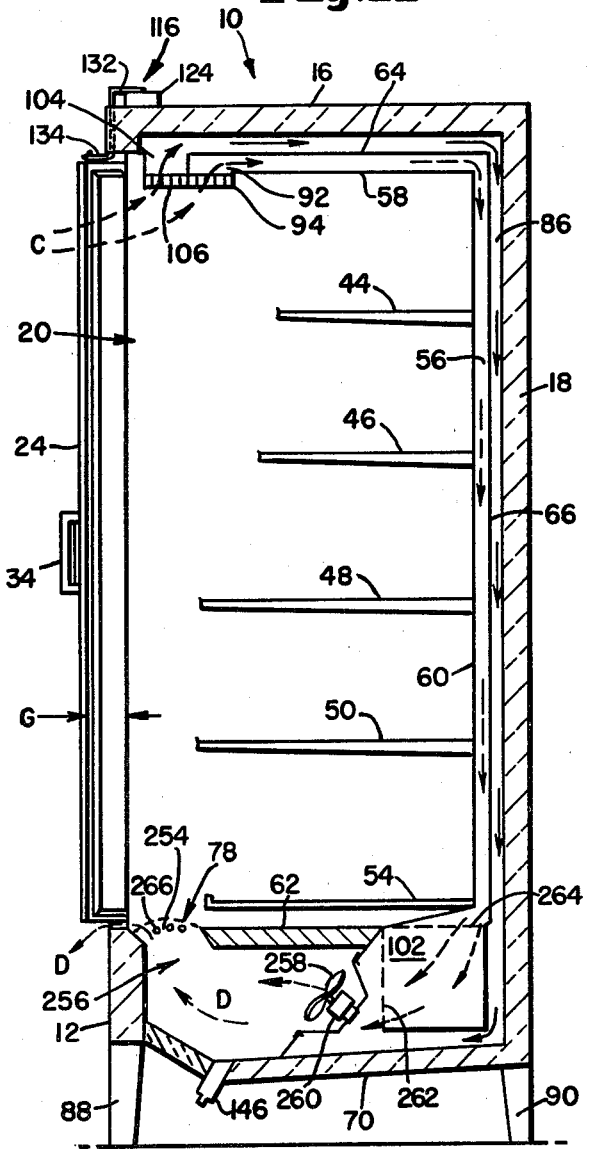
FIG. 17 is a side cross-sectional view of the cabinet illustrated in FIG. 16 shown in a defrost cycle with the door opened.

FIGS. 16 and 17 show another modification of the refrigerated display cabinet illustrated in FIGS. 1–6. In this embodiment a common air inlet conduit chamber of portion 256 is provided below air grille 78 at the bottom of the cabinet 10. The primary air band labeled A in FIG. 16 flows downwardly in front of shelves 44, 46, 48, 50 and bottom shelf 54 and then enters the common inlet conduit portion 256 along with the secondary air band labeled B in FIG. 16. In the common inlet conduit portion 256 the two air bands commingle and the specific heat of the secondary band is partly absorbed by the air in the primary band with the result that the secondary air band B is held at a somewhat lower temperature than that same air band in modification shown in FIGS. 1–6.

The modification shown in FIGS. 16 and 17 offers the improved advantage of having a simpler construction since the two air bands A and B are both propelled by a common conduit fan 258 and its associated motor 260 which are designed for the heavier load requirements since it is the sole air moving means in a given longitudinal section of the refrigerated cabinet 10 as shown. Low temperature element 102 containing the refrigeration coils cools the primary air band A by means of contact of that air band with the coils as air passes through the element in the direction of the air flow arrows and as indicated by the flow perforations 262 and 264. Air band A is then propelled upward in the rear portion of primary conduit 56 between the two rear panels 60 and 66 and then across the top of the same conduit in the same fashion as described with respect to FIG. 2. This primary air band A is then propelled out of outlet 92 and through downwardly directed louvers 94 and then along the front portions of the shelves as described above. The secondary air band B flows in a parallel path out of outlet 104 and through downwardly directed louvers 106 and then at the bottom of cabinet 10 into air grille 78 and thereafter into common conduit chamber 256. Fan 258 and motor 260 then force part of the commingled air streams into secondary air conduit 86 located immediately below low temperature element 102. This secondary air stream is then propelled upwardly in the secondary air conduit 86 formed by rear wall 18 and the rear divider panel 66. If desired, heated liquid lines 266 can be provided in association with air grille 78 in the manner described with respect to FIGS. 9, 12 and 13. Also a bottom drain 146 is provided and an insulated bottom panel 62 as in FIGS. 1–6.

When the front accumulation sensing device indicates a sufficient frost build up on the coils in low temperature element 102 or after the passage of a predetermined time period during which such build up ordinarily occurs the operation of refrigerated cabinet 10 is switched by its associated control means to a defrost cycle. At the initiation of this cycle refrigerant flow through low temperature element 102 is terminated by the control means and door operating mechanism 116 at the top of the cabinet is activated by the air defrost means. When door 24 has been opened as shown in FIG. 17 by operating mechanism 116 motor 260 is reversed so that common conduit fan 258 propels both air bands in an opposite direction to that shown in FIG. 16 for the refrigeration cycle. The reverse direction air flow in primary conduit 56 then passes ambient air through cabinet 10 and through the gap G created between door 24 and access opening 20. In this manner ambient air shown by the dashed arrow C is propelled in conduit 56 and then into contact with the frost and ice accumulated on the surfaces of the coils in low temperature element 102 causing the same to melt and the resulting water to be drained through bottom drain 146. During this reversed band flow in the defrost cycle, air is also propelled in a reverse direction from that in the refrigeration cycle of FIG. 16 in the secondary conduit 86. Since this reverse air flow in conduit 86 does not contribute to the defrosting action, the volume of air flow is controlled by designing the conduit widths to achieve optimum cabinet refrigeration and defrost performance in both operating cycles, in order to achieve low energy operation. The air bands in the defrost cycle are then propelled by fan 258 through the common conduit portion 256, through air grille 78 which covers the common conduit inlet 254. Thereafter the commingled air bands are expelled from cabinet 10 through the lower portion of gap G created between barrier door 24 and its associated access opening 20. Those air bands then contain moisture evaporated from the frost and ice around the coils and low temperature element 102 and is therefore at a slightly lower temperature than when drawn into the top portion of gap G. Thus the somewhat colder air flows downwardly upon exiting from gap G rather than continuing upward within cabinet 10.

Figure 19:
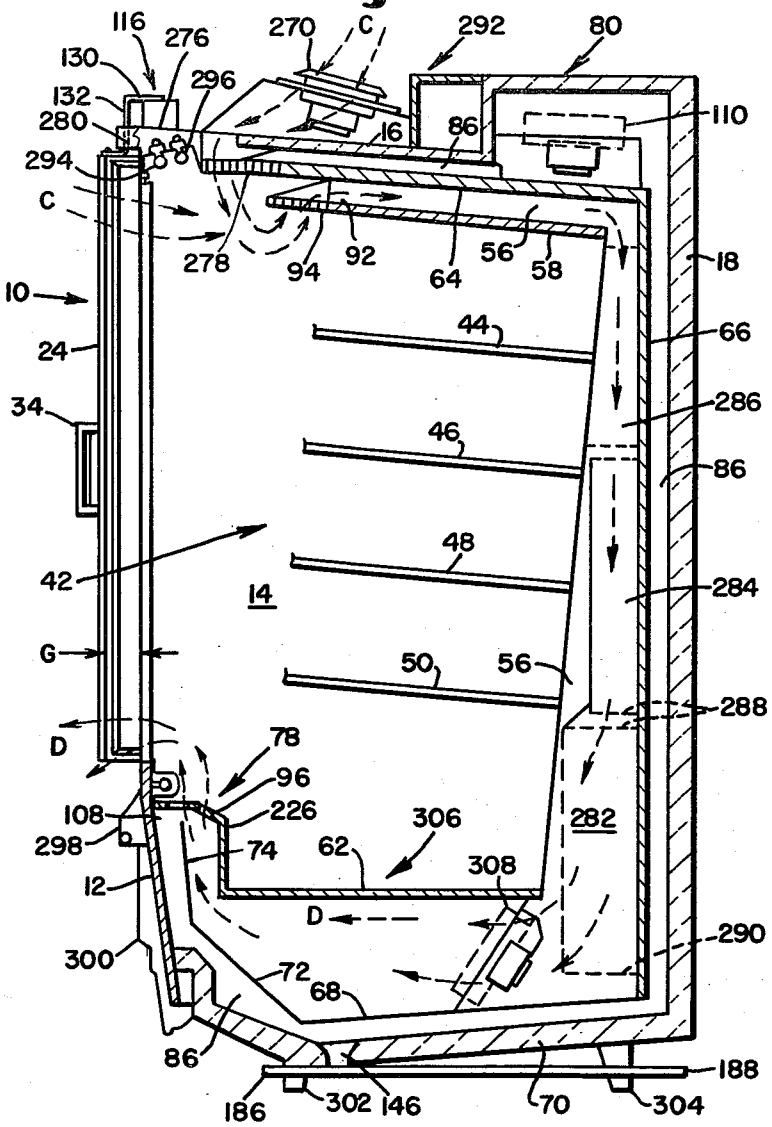
FIG. 19 is a side sectional schematic view of the embodiment of the display cabinet of FIG. 18 shown in a defrost cycle of operation.
Figure 18:
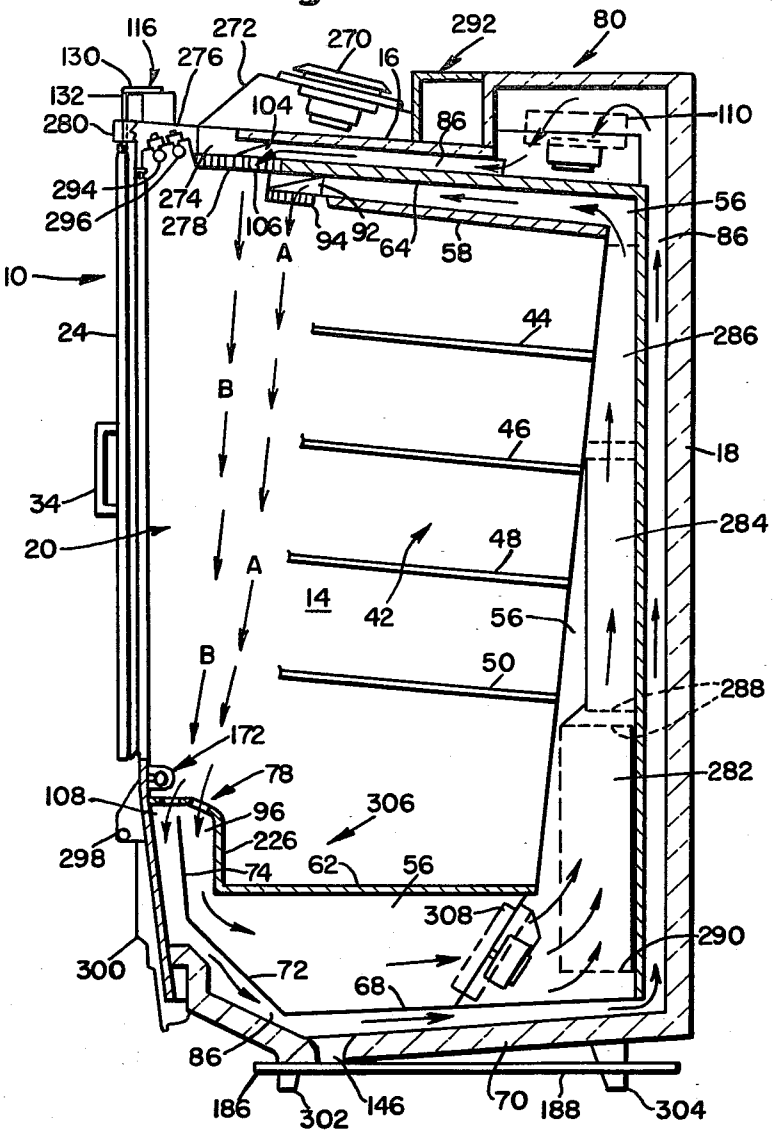
FIG. 18 is a side sectional schematic view of another embodiment of the refrigerated display cabinet in accordance with the present invention shown in a refrigeration cycle of operation wherein an auxiliary ambient air fan is provided.

FIGS. 18 and 19 show another modification of the refrigerated cabinet 10 wherein an auxiliary air fan 270 is mounted in a hood 272 arranged on top of wall 16. In this modification an auxiliary air outlet opening 274 is positioned between the secondary conduit outlet opening 104 and light support housing 276. Auxiliary air outlet 274 is also equipped with downwardly directed louvers 278 in order to channel the auxiliary air flow in an initial downward direction. Such as tertiary air band propelling means is operated only during the defrost cycle in order to increase the intake of ambient air into cabinet 10.

Auxiliary fan 270 is not operated in the refrigeration cycle since the cabinet is operated in the refrigeration cycle without significant inflow or outflow of ambient air. In the defrost cycle of operation shown in FIG. 19; auxiliary fan 270 is activated after door 24 has been partly opened by door operating mechanism 116 in order to provide an additional tertiary air band which is propelled downward from louvers 278. This auxiliary air band is then drawn into the primary conduit louvers 94 covering the primary conduit outlet 92 to thus entrain and commingle additional ambient air C which is drawn into cabinet 10 through gap G. This modification functions to increase the air temperature and throughflow in the reverse flow primary air band so that the evaporator coils of the refrigeration means are more quickly defrosted.

As shown in FIGS. 18 and 19 the door opening mechanism 116 can be mounted directly on the light support housing 276 and the rotating operator rod 132 can be supported by a support cowl 280 which is attached to light housing 276. Operation of door opening mechanism 116 is the same as described with respect to FIGS. 1–6 above.

The modification of cabinet 10 shown in FIGS. 18 and 19 has three low temperature elements 282, 284 and 286 arranged in primary air conduit 56 and numbered in the direction of the primary air band flow during the refrigeration cycle as shown in FIG. 18. Air flow is in the direction of the solid arrows and passes through those portions of these low temperature elements as shown by the perforations 288 and 290. A bottom drain 146 with connected tubes 186 and 188 are provided similar to the detailed view of cabinet 10 shown in FIG. 6. Other elements such as bottom light housing 172 and the insulated outer wall structure are similar to those shown in FIG. 6. In addition, a control housing 292 is fit between secondary fan housing 80 and auxiliary fan hood 272 at the top cabinet 10. This housing can be used to store automatic control circuitry and equipment for sensing the ambient conditions of the store in which cabinet 10 is positioned and for a conductor wire-way. A double row of lights 294 and 296 are shown in light housing 276, and correspond to light bulb 168 shown in FIG. 6. Also shown in the more detailed FIGS. 18 and 19 is a bumper rail 298 and the end panel trimming 300 which extends beyond end panel 14. Support legs 302 and 304 are also provided for this cabinet structure. A storage space 306 is provided in the bottom part of display space 42 for the storage of products which require refrigeration. The primary and secondary conduits 56 and 86 are closely similar to those described with respect to FIGS. 1–5 above wherein a bottom divider panel 68 is provided and is connected to a front inclined divider panel 72 which is in turn connected to a vertical divider panel 74 which extends up to the underside of air grille 78 thereby forming the inlets for the primary and secondary conduits 96 and 108, respectively.

As shown in FIG. 18 the secondary air band B enters inlet 108 and proceeds through conduit 86 under propulsion of the secondary fan 110 located in secondary fan housing 80 at the top of the cabinet. Secondary air conduit 86 then continues at the top of the cabinet between top wall 16 and upper divider panel 64 which is shown as an insulated panel. The secondary conduit outlet 104 is positioned at the terminal end of the secondary conduit 86 which has downwardly directed louvers 106 as shown in FIGS. 1–3.

At the initiation of the defrost cycle the following changes occur: refrigerant flow in the coils of low temperature elements 282, 284 and 286 is terminated, door operating mechanism 116 rotates rod 132 in order to open door 24 and to create the gap G shown in FIG. 19, secondary fan 110 operation is terminated, and primary fan 308 reverses its rotational direction in order to move air band A in the opposite direction, and auxiliary fan 270 operation is initiated. Ambient air, C, is then propelled by auxiliary fan 270 through downward directed louvers 278 and additional ambient air is drawn in by aspiration action through the top portion of gap G and into the primary conduit downward directed louvers 94 and the associated primary conduit outlet 92 in order to pass ambient air with its higher temperature and specific heat through the coils of, first, low temperature element 286 and thereafter elements 284 and 282 as shown in FIG. 19. The defrost air shown by dashed arrows is then expelled from cabinet 10 through the lower portion of gap G. At the end of the defrost cycle as determined by one or more of the means set out above, door 24 is closed by operation of door operating mechanism 116, the operation of auxiliary fan 270 is terminated, refrigerant is again pumped through the coils in elements 282, 284 and 286, and secondary fan 110 is initiated along with primary conduit fan 308 now operated in the refrigeration air flow direction as shown in FIG. 18.

Figure 20:
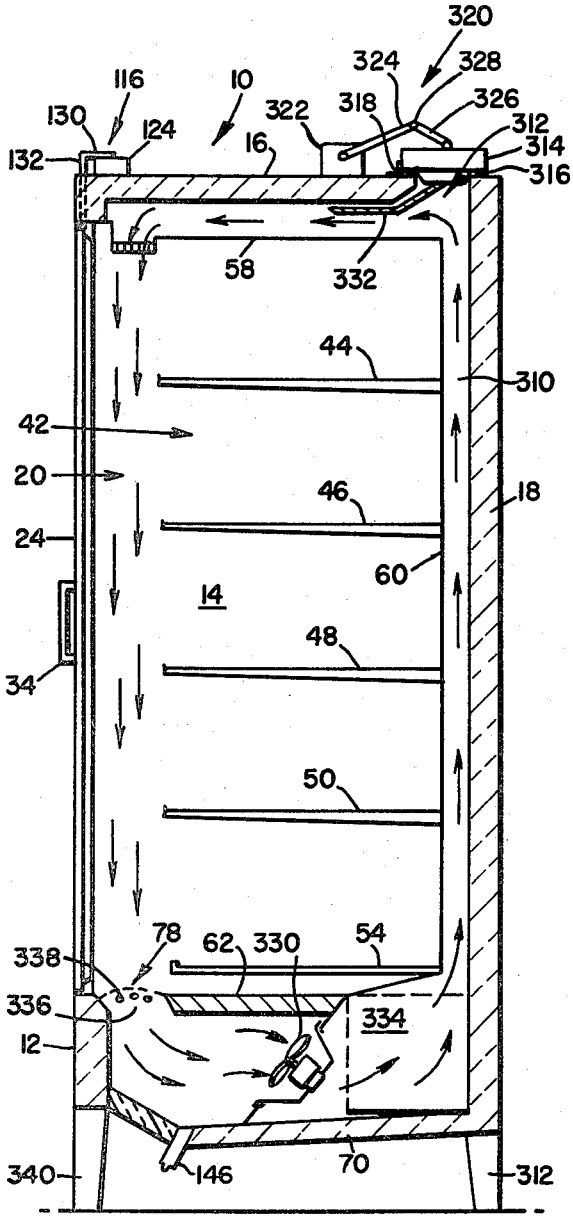
FIG. 20 is a side sectional schematic view of another embodiment of the refrigerated display cabinet wherein a single air conduit is provided and an additional air passage port is located in the top wall of the cabinet as seen in a refrigeration mode of operation.
Figure 21:
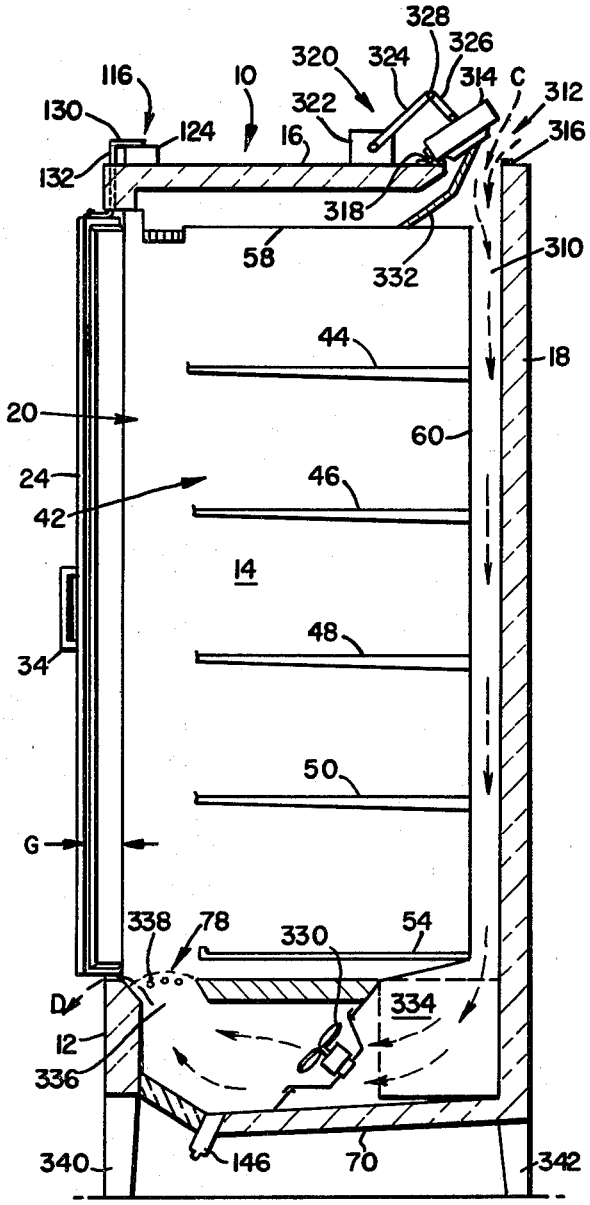
FIG. 21 is a side sectional schematic view of the embodiment shown in FIG. 20 wherein the air passage port is shown in an open position during a defrost mode of operation.

FIGS. 20 and 21 illustrate another embodiment of the cabinet 10 wherein only a single air conduit 310 is arranged between the outer walls 12, 14, 16, 18 and 70 and the panels forming display space 42. In this modification an air passage port 312 is arranged in the rear portion of top wall 16 and is covered during the refrigeration cycle of operation by closure of lid 314 against a ring seal 316. Closure lid 314 is hinged at the front edge thereof by hinge 18 and is operated by a motor and linkage mechanism 320 which is composed of motor 322 and linkages 324 and 326 which are hinged by pin 328. During the beginning defrost cycle of operation closure lid 314 is opened by operation of motor 322 and ambient air C is drawn into air conduit 310 as shown in FIG. 21 by the air conduit fan 330 which, in this modification, is a reversible fan. The door operating mechanism 116 causes door 24 to open so that the defrost air, D, can be ejected at the bottom portion of gap, G. If desired a barrier baffle 332 can be attached to the under surface of closure lid 314 in order to close off the top portion of air conduit 310 so that ambient air enters substantially through air passage port 312 rather than being drawn through the gap G created between the top of door 24 and the access opening 20. The access opening 20 and air passage port 312 thus provide aperture means for cabinet 10 which was provided solely by the gap between the door or doors and the access opening or openings in the previously described embodiments.

A single evaporator coil set 334 has been shown positioned in the bottom portion of air conduit 310 in FIGS. 20 and 21. The other elements of the modification of the refrigerated cabinets shown in FIGS. 20 and 21 are substantially similar to the corresponding elements in the embodiment of cabinet 10 illustrated in FIGS. 16 and 17 and hence consistent character numerals have been employed.

During the refrigeration cycle it is possible for condensation to accumulate on the air grille 78 at the conduit inlet opening 336. Such condensation can eventually lead to the formation of frost, thereby blocking the openings in the grille work. In order to minimize such a condition, liquid lines 338 can be provided as part of the grille structure at inlet opening 336. Refrigeration system liquid flowing between the condensor and the evaporator coils is pumped through liquid lines 338 in order to raise the temperature of the grille work sufficiently to eliminate frost buildup thereon. Support legs 340 and 342 can also be provided.

When the sensing and control means initiates a defrost cycle the refrigeration air band flow shown in FIG. 20 is interrupted by the following sequence of operations: door operating mechanism 116 opens door 24 and creates a gap, G, between the door and its associated access opening 20; motor 322 operates through linkages 334 and 326 to open closure lid 314 to thereby communicate ambient air C with the rear portion of air conduit 310; air conduit fan 330, now operated in a reverse direction, propels the ambient air, C, through low temperature element 344 which is located within conduit 310 so that all air being propelled by conduit fan 330 is drawn through the coil of the low temperature element. The defrost air band is then expelled from cabinet 10 through the lower portion of gap, G, in a manner similar to that described for operation of the cabinet in FIGS. 16 and 17. Upon termination of the defrost cycle door 24 and closure lid 314 are returned to the position shown in FIG. 20 and air conduit fan 330 is operated in the refrigeration air flow direction as shown by the solid arrows in FIG. 20.

An air passage port of the type described can also be provided for interconnection with the primary air conduit in FIGS. 1–6 and 16–19 to allow improved air flow patterns when the defrost ambient air is propelled upward in the primary air conduit during the defrost cycle. In this manner the defrost air can be ejected from the top of the cabinet 10.

In the various embodiments of the present invention the defrost cycle encompasses the steps of causing ambient air to be drawn into the cabinet and to pass across the refrigeration means and through some portion of the primary air conduit and to be expelled from the cabinet, and of creating a gap between the barrier door and the access opening to enable ambient air through-flow. The ambient air can be made to flow in either the primary and/or secondary air conduits. Ambient air contact with the refrigeration means is common to these embodiments.

The various modifications illustrated in FIGS. 7–21 can be intercombined so that various features of the modifications can be employed to optimize operation of cabinet 10 and the energy requirements therefor.

The provision of the air defrost means of the present invention embodied in the door opening mechanisms of the type illustrated by numeral 116 and the air defrost means which operates this mechanism and the reversible fans in the primary and/or secondary conduits, in the several embodiments, overcomes the above described problems by allowing the barrier doors to be partially opened and the defrost ambient air to be drawn in and ejected through the gap created between the open barrier doors and the access opening. In this manner low energy operational advantages of both barrier doors and circulating air bands can be provided for refrigerated glass door merchandiser type cabinets.

Figure 22:
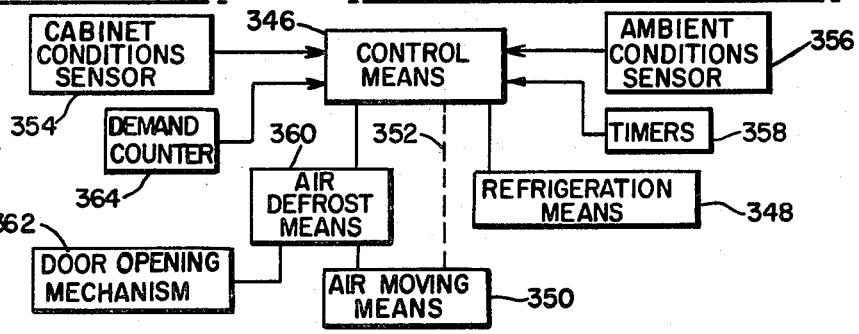
FIG. 22 is a schematic diagram of the control hierarchy involved in the operation of the refrigerated display case.

Referring to FIG. 22, a block diagram of the control hierarchy is set forth. Open front refrigerated display cabinets conventionally have control means 346 for operating refrigeration means 348 and air moving means 350, connected by dashed control line 352, in order to permit operation in a refrigeration and a defrost cycle. Devices such as cabinet condition sensors 354, ambient condition sensors 356 and timers 358 are also provided as set forth in the above MODES OF OPERATION section. The display cabinet 10 shown in FIG. 1 is provided with an air defrost means 360 which controls the door operating mechanisms 114, 116, 118, 120 and 122 represented by the block 362. The air moving means 350 which controls the power to the first, second and auxiliary air fan sets is then connected through the air defrost means for control thereof during the defrost cycle. Various air fans of the air moving means 350 can also be selectively controlled during portions of the refrigeration cycle by signals such as those generated by a demand counter circuit 364 activated by a door operated switch. The signal input is fed into the control means and used to selectively control power to the air moving means fans or sets of fans. A counting circuit can be provided within block 364 to initiate a defrost cycle when a predetermined number of door openings occur in relation to time or other conditions. The internal circuitry used within blocks 346, 360 and 364 need only be consistent with these and the other disclosed modes of operation in order to control power to the various operating devices. The control means can selectively operate the air moving means independently of the door opening mechanism 362 via line 352, for example, when the demand counter is used. This type of control during the refrigeration cycle permits the secondary fans illustrated by fan 110 to be switched on only when the barrier door is opened so that the low temperature primary band is better protected from direct contact with the ambient air. The auxiliary air fan can be operated in the same way to provide an ambient air guard band during a refrigeration cycle when the barrier door is opened. The refrigeration means 348 includes a conventional functioning compressor, condensor, receiver, expansion valve and evaporator coil sets arranged in a refrigeration circuit.

If desired, heater elements of either electrical resistance or liquid line types can be positioned on the defrost upstream side of refrigeration elements 102, 282–286, and 334 in order to increase the ambient air stream temperature. Applicant's U.S. Pat. No. 4,265,092 shows such heater elements. Also, the barrier doors in the various embodiments, and particularly, the one illustrated in FIGS. 1–5 can be of the construction described in U.S. Pat. No. 3,331,159 to Cook et al wherein a surrounding door frame is provided and which is assigned to the assignee of the present application.

The invention may be embodied in other specific forms without departing from the spirit or essential characteristics thereof. The present embodiments are, therefore, to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. In a display cabinet having refrigeration means and a display space therein, aperture means in at least one wall of said cabinet for communicating ambient outside air with the air in said cabinet, said aperture means comprising an access opening for permitting products to be moved into and out of said display space, air moving means for circulating at least one air band within said cabinet and into contact with said refrigeration means during a refrigeration cycle, covering means for said aperture means including a barrier door for substantially covering said access opening, and said refrigeration means including a low temperature element; the improvement comprising: air defrost means for selectively creating a gap between said barrier door and said access opening, said air defrost means causing said air moving means to pass ambient air through said cabinet and through the gap between said barrier door and said access opening during a defrost cycle to bring the ambient air into contact with said low temperature element to remove frost therefrom and to thereafter eject the defrost ambient air from said cabinet, means for providing a plurality of air bands for circulation within said cabinet during a refrigeration cycle, and, control means for selectively operating said air defrost means and said refrigeration means to defrost said low temperature element during a defrost cycle and to refrigerate said cabinet during a refrigeration cycle.

2. The improvement according to claim 1, wherein said aperture means includes an air passage port in a wall of said cabinet, and wherein said air moving means passes ambient air through said cabinet by moving air through said air passage port and through the gap between said carrier door and said access opening during a defrost cycle.

3. The improvement according to claim 1, wherein said aperture means includes an air passage port in a wall of said cabinet, and wherein said air moving means draws ambient air into said cabinet through said air passage port and ejects defrost ambient air through the gap between said barrier door and said access opening during a defrost cycle.

4. The improvement according to claim 1, wherein during a defrost cycle said air defrost means creates the gap between said barrier door and said access opening and causes said air moving means to draw ambient air into said cabinet through a first portion of said gap and to eject the defrost ambient air through a second portion of said gap.

5. The improvement according to claim 1, wherein during a defrost cycle said air defrost means selectively creates the gap between said barrier door and said access opening and permits said barrier door to substantially cover said access opening during a refrigeration cycle to thereby conserve operating energy for said display cabinet.

6. The improvement according to claim 1, wherein said air moving means for circulating at least one air band within said cabinet comprises a first air circulation means for propelling a primary refrigerated air band, and a second air circulation means for selectively propelling a secondary air guard band in the same direction as said primary air band during a refrigeration cycle and for drawing ambient air into said secondary air band and then propelling the ambient air through said cabinet in a reverse direction to said refrigerated air band and into contact with said low temperature element during a defrost cycle.

7. The improvement according to claim 6, wherein said cabinet includes an air guidance means for deflecting at least a portion of said secondary air guard band into said primary air band during a defrost cycle.

8. The improvement according to claim 7, wherein said guidance means deflects substantially all of said secondary air band into said primary air band.

9. The improvement according to claim 6, including a primary air conduit arranged inside said cabinet about said display space for containing said primary refrigerated air band and a secondary air conduit arranged within said cabinet adjacent to said primary air conduit for containing said secondary air guard band, said secondary air circulation means propelling said secondary air band in the same direction as said primary air band during a refrigeration cycle to provide a guard function for said primary band and in the opposite direction from the flow of said primary air band during a defrost cycle of operation.

10. The improvement according to claim 9, wherein said cabinet includes an air guidance means for deflecting at least a portion of the air flow in said secondary air guard band into said primary air conduit during a defrost cycle when said secondary air band is propelled in the opposite direction to the flow direction of said primary air band.

11. The improvement according to claim 6, wherein said second air circulation means includes at least one two-directional air fan for propelling said secondary air band in either direction.

12. The improvement according to claim 6, wherein said control means contains means for reducing the refrigeration function of said refrigeration means at the beginning of a defrost cycle, causing said air defrost means to create a gap between said barrier door and said access opening, and reversing the flow of said secondary air band from the direction of flow of said primary refrigeration air band during a refrigeration cycle to the opposite direction and drawing ambient air through the gap into said cabinet and moving said ambient air over said low temperature element of said refrigeration means to defrost the same and to thereafter eject the defrost ambient air through said aperture means.

13. The improvement according to claim 1, wherein said air moving means includes an auxiliary air circulation means for increasing ambient air inflow into said display cabinet and for commingling the ambient air with said air band during a defrost cycle.

14. In a display cabinet having refrigeration means and a display space therein, aperture means in at least one wall of said cabinet for communicating ambient outside air with the air in said cabinet, said aperture means comprising an access opening for permitting products to be moved into and out of said display space, air moving means for circulating at least one air band within said cabinet and into contact with said refrigeration means during a refrigeration cycle, covering means for said aperture means including a barrier door for substantially covering said access opening, and said refrigeration means including a low temperature element; the improvement comprising: air defrost means for selectively creating a gap between said barrier door and said access opening, said air defrost means causing said air moving means to pass ambient air through said cabinet and through the gap between said barrier door and said access opening during a defrost cycle to bring the ambient air into contact with said low temperature element to remove frost therefrom and to thereafter eject the defrost ambient air from said cabinet, control means for selectively operating said air defrost means and said refrigeration means to defrost said low temperature element during a defrost cycle and to refrigerate said cabinet during a refrigeration cycle, and said air moving means comprising a first air circulation means for propelling a primary refrigerated air band during a refrigeration cycle and a secondary air circulation means for propelling a secondary air guard band in the same direction as said primary air band during a refrigeration cycle, said air defrost means selectively reversing the direction of flow of said primary air band and terminating operation of said refrigeration means and of said secondary air circulation means during a defrost cycle to prevent flow of said secondary air guard band whereby ambient air is passed through said cabinet by said primary air band.

15. The improvement according to claim 14 wherein said secondary air circulation means is prevented from propelling said secondary air band during portions of the refrigeration cycle in which said barrier door is not opened.

16. The improvement according to claims 6 or 14 wherein said control means contains sensing means for detecting the opening of said barrier door and wherein said control means operates said secondary air circulation means for propelling said secondary air band in the same direction as said primary refrigerated air band selectively in response to the opening of said barrier door during a refrigeration cycle.

17. The improvement according to claim 14 wherein said control means includes means for sensing the refrigeration condition within said display space and means for selectively operating said air moving means to propel said secondary air band in the same direction as said primary refrigerated air band opening upon the refrigeration condition sensed.

18. The improvement according to claim 1, wherein lighting means is included in said cabinet for illuminating said display case.

19. In a display cabinet having refrigeration means and a display space therein, aperture means in at least one wall of said cabinet for communicating ambient outside air with the air in said cabinet, said aperture means comprising an access opening for permitting products to be moved into and out of said display space, air moving means for circulating at least one air band within said cabinet and into contact with said refrigeration means during a refrigeration cycle, covering means for said aperture means including a barrier door for substantially covering said access opening, and said refrigeration means including a low temperature element; the improvement comprising: air defrost means for selectively creating a gap between said barrier door and said access opening, said air defrost means causing said air moving means to pass ambient air through said cabinet and through the gap between said barrier door and said access opening during a defrost cycle to bring the ambient air into contact with said low temperature element to remove frost therefrom and to thereafter eject the defrost ambient air from said cabinet, control means for selectively operating said air defrost means and said refrigeration means to defrost said low temperature element during a defrost cycle and to refrigerate said cabinet during a refrigeration cycle, said air moving means comprising a first air circulation means for selectively propelling a primary refrigerated air band within a primary conduit contained in said cabinet and a second air circulation means for selectively propelling a second air guard band within a secondary conduit contained in said cabinet in the same direction as said primary air band during a refrigeration cycle, said air defrost means during a defrost cycle of operation terminating operation of said second air circulation means and causing said primary air band to draw ambient air from outside said cabinet and to contact said low temperature element with said primary air band containing the ambinet air.

20. The improvement according to claim 14, wherein during a defrost cycle of operation said first air circulation means is caused to reverse the flow of said primary air band from the direction of flow during a refrigeration cycle of operation and to discharge defrost ambient air through a portion of said aperture means other than said access opening.

21. The improvement according to claim 14, wherein during a defrost cycle of operation defrost ambient air is discharged from said cabinet through the gap between said barrier door and said access opening.

22. The improvement according to claim 14, wherein said air moving means includes an auxiliary air circulation means for increasing ambient air inflow into said display cabinet and for comingling the ambient air with said primary air band during a defrost cycle of operation in which the direction of air flow is maintained the same as in a refrigeration cycle, and wherein the defrost ambient air is discharged from said cabinet through the gap between said barrier door and said access opening.

23. The improvement according to claim 1, including a primary air conduit arranged inside said cabinet about said display space for containing a primary refrigerated air band during a refrigeration cycle of operation, and a secondary air conduit arranged within said cabinet adjacent to a substantial portion of said primary air conduit, and said secondary air conduit connected at an inlet end thereof to said primary air conduit, said primary and said secondary conduits being separate along the lengths thereof from said secondary conduit inlet and to the outlet end thereof, and said cabinet including a common conduit inlet chamber for said primary refrigerated air band and a secondary air band flowing in said secondary air conduit.

24. The improvement according to claim 23, wherein during a refrigeration cycle of operation said air moving means propels said primary air band within said primary air conduit and through said common conduit inlet portion and propels said secondary air band within said secondary air conduit and through said common conduit inlet chamber, and wherein during a defrost cycle of operation said air defrost means causes said air moving means to reverse the flow direction of said primary and secondary air bands and to draw ambient air into said cabinet and into contact with said low temperature element for defrosting.

25. In a display cabinet having refrigeration means and a display space therein, aperture means in at least one wall of said cabinet for communicating ambient outside air with the air in said cabinet, said aperture means comprising an access opening for permitting products to be moved into and out of said display space, air moving means for circulating at least one air band within said cabinet and into contact with said refrigeration means during a refrigeration cycle, covering means for said aperture means including a plurality of barrier doors attached to said display cabinet for substantially covering said access opening, and said refrigeration means including a low temperature element; the improvement comprising: air defrost means for selectively creating a gap between said barrier door and said access opening, said defrost means causing said air moving means to pass ambient air through said cabinet and through the gap between said barrier door and said access opening during a defrost cycle to bring the ambient air into contact with said low temperature element to remove frost therefrom and to thereafter eject the defrost ambient air from said cabinet, and said air defrost means selectively creating a gap between at least alternate doors of said plurality of doors and said access opening during a defrost cycle of operation, and, control means for selectively operating said air defrost means and said refrigeration means to defrost said low temperature element during a defrost cycle and to refrigerate said cabinet during a refrigeration cycle.

26. The improvement according to claim 25, wherein said air defrost means creates a gap between substantially all of said barrier doors and said access opening simultaneously.

27. The improvement according to claim 25, wherein said barrier doors contain therein a transparent material viewing port.

28. The improvement according to claim 25, wherein said air defrost means comprises a series of door operating mechanisms arranged for individually and selectively creating a gap between each of said barrier doors and said access opening during a defrost cycle.

29. The improvement according to claim 25, wherein said air defrost means comprises a door operating mechanism for selectively creating a gap between at least alternate doors in a series of said barrier doors and said access opening.

30. A display cabinet having a refrigeration means and a display space therein comprising: a cabinet having top, bottom, and end and side walls and having aperture means in at least one wall thereof for communicating ambient outside air with the air in said cabinet, said aperture means comprising an access opening for permitting access to said display space; covering means for said aperture means including a barrier door for substantially covering said access opening, said door being movable for enabling access to products within said display space; a primary air conduit arranged about said display space and having an outlet opening and an inlet opening at opposing ends thereof, said outlet opening and said inlet opening being arranged in aerodynamic alignment; a primary air band contained within said primary air conduit which upon leaving said outlet opening will be directed toward and received by said inlet opening to form an air curtain across said access opening along a path inside of said barrier door; a secondary air conduit arranged about said primary air conduit and extending along said top, bottom, rear and side walls of said cabinet; a secondary air band contained within said secondary air conduit; said refrigeration means including a low temperature element; air moving means for circulating said primary and said secondary air bands within said air conduits within said air conduits and for moving said primary air band into contact with said low temperature element during a refrigeration cycle of operation; air defrost means for selectively creating a gap between said barrier door and said access opening; said air defrost means causing said air moving means to pass ambient air through said cabinet and through said aperture means during a defrost cycle of operation to bring said ambient air into contact with said low temperature element to remove frost therefrom and to thereafter eject the defrost ambient air from said cabinet; and, control means for selectively operating said air defrost means and said refrigeration means to defrost said low temperature element during a defrost cycle and to refrigerate said cabinet during a refrigeration cycle.

31. A display cabinet according to claim 30, wherein said aperture means includes an air passage port in a wall of said cabinet, and wherein said air moving means passes ambient air through said cabinet by moving air through said air passage port and through the gap between said barrier door and said access opening during a defrost cycle.

32. A display cabinet according to claim 30, wherein said aperture means includes an air passage port in a wall of said cabinet, and wherein said air moving means draws ambient air into said cabinet through said air passage port and ejects the defrost ambient air through the gap between said barrier door and said access opening during a deforst cycle.

33. A display cabinet according to claim 30, wherein during a defrost cycle said air means creates the gap between said barrier door and said access opening and said air moving means draws ambient air into said cabinet through a first portion of the gap and ejects the defrost ambient air through a second portion of the gap.

34. A display cabinet according to claim 30, wherein said air defrost means selectively creates a gap of preset distance between said barrier door and said access opening.

35. A display cabinet having a refrigeration means and a display space therein comprising: a cabinet having top, bottom, end and side walls and having aperture means in at least one wall thereof for communicating ambient outside air with the air in said cabinet, said aperture means comprising an access opening for permitting access to said display space; covering means for said aperture means including a barrier door for substantially covering said access opening, said door being movable for enabling access to products within said display space; at least one air conduit extending along said top, bottom, rear and side walls about said display space and having an outlet opening and an inlet opening at opposing ends thereof, said outlet opening and said inlet opening being arranged in aerodynamic alignment; an air band contained within said air conduit which upon leaving said outlet opening will be directed toward and received by said inlet opening to form an air curtain across said access opening along a path inside of said barrier door; said refrigeration means including a low temperature element; air moving means for circulating said air band within said air conduit for moving said air band into contact with said low temperature element during a refrigeration cycle of operation; air defrost means for selectively creating a gap of variable distance between said barrier door and said access opening depending upon the amount of frost accumulation on said refrigeration means and the time period for the defrost cycle; said air defrost means causing said air moving means to pass ambient air through said cabinet and through said aperture means during the defrost cycle of operation to bring said ambient air into contact with said low temperature element to remove frost therefrom and to thereafter eject the defrost ambient from said cabinet; and, control means for selectively operating said air defrost means and said refrigeration means to defrost said low temperature element during a defrost cycle and to refrigerate said cabinet during a refrigeration cycle.

36. A display cabinet according to claims 34 and 35, wherein the gap distance between said barrier door and said access opening is approximately 1 to 7 inches.

37. A display cabinet having a refrigeration means and a display space therein comprising: a cabinet having top, bottom, end and side walls and having aperture means in at least one wall thereof for communicating ambient outside air with the air in said cabinet, said aperture means comprising an access opening for permitting access to said display space; covering means for said aperture means including a barrier door for substantially covering said access opening, said door being movable for enabling access to products within said display space; at least one air conduit extending along said top, bottom, rear and side walls about said display space and having an outlet opening and an inlet opening at opposing ends thereof, said outlet opening and said inlet opening being arranged in aerodynamic alignment; an air band contained within said air conduit which upon leaving said outlet opening will be directed toward and received by said inlet opening to form an air curtain across said access opening along a path inside of said barrier door; said refrigeration means including a low temperature element; air moving means for circulating said air band within said air conduit and moving said air band into contact with said low temperature element during a refrigeration cycle of operation; air defrost means for selectively creating a gap between said barrier door and said access opening; said air defrost means causing said air moving means to pass ambient air through said cabinet and through said aperture means during a defrost cycle of operation to bring said ambient air into contact with said low temperature element to remove frost therefrom and to thereafter eject the defrost ambient air from said cabinet; control means for selectively operating said air defrost means and said refrigeration means to defrost said low temperature element during a defrost cycle and to refrigerate said cabinet during a refrigeration cycle, said air conduit comprising a primary air conduit containing a primary refrigerated air band and a secondary air conduit extending about a substantial portion of said primary air conduit and having a secondary conduit outlet opening and an inlet opening at opposite ends thereof, said secondary conduit outlet opening and said inlet opening being arranged in aerodynamic alignment; a secondary air band contained within said secondary air conduit which upon leaving said outlet opening is directed toward and received by said inlet opening to form a secondary air guard curtain across said access opening along a path outside of said primary air band and inside of said barrier door during the refrigeration cycle.

38. A display cabinet according to claim 37, wherein said air moving means includes at least one two-directional air fan located in said secondary air conduit, said air moving means selectively propels said secondary air band within said secondary air conduit in the same direction as said primary air band during a refrigeration cycle and in a reverse direction during a defrost cycle, an air guidance means is located in said cabinet for diverting at least a portion of said secondary air band into said primary air conduit during a defrost cycle, said air defrost means functions to propel said air bands during a defrost cycle to draw ambient air into said cabinet through said aperture means, to co-mingle the ambient air with said secondary air band, to propel said secondary air band through said secondary conduit then into said primary air conduit inlet prior to movement across said refrigeration means for defrosting said low temperature element and ejecting the defrost air from said display cabinet through the gap created between said barrier door and said access opening.

39. A display cabinet according to claim 37, wherein an airflow guidance means is provided to communicate said secondary air conduit inlet with said primary air conduit for deflecting at least a portion of said secondary air band from said secondary conduit into said primary conduit during a defrost cycle.

40. A display cabinet having a refrigeration means and a display space therein comprising: a cabinet having top, bottom, end and side walls and having aperture means in at least one wall thereof for communicating ambient outside air with the air in said cabinet, said aperture means comprising an access opening for permitting access to said display space; covering means for said aperture means including a barrier door for substantially covering said access opening, said door being movable for enabling access to products within said display space; at least one air conduit extending along side top, bottom, rear and side walls about said display space and having an outlet opening and an inlet opening at opposing ends thereof, said outlet opening and said inlet opening being arranged in aerodynamic alignment; an air band contained within said air conduit which upon leaving said outlet opening will be directed toward and received by said inlet opening to form an air curtain across said access opening along a path inside of said barrier door; said refrigeration means including a low temperature element; air moving means for circulating said air band within said air conduit and moving said air band into contact with said low temperature element during a refrigeration cycle of operation; air defrost means for selectively creating a gap between said barrier door and said access opening; said air defrost means causing said air moving means to pass ambient air through said cabinet and through said aperture means during a defrost cycle of operation to bring said ambient air into contact with said low temperature element to remove frost therefrom and to thereafter eject the defrost ambient air from said cabinet; control means for selectively operating said air defrost means and said refrigeration means to defrost said low temperature element during a defrost cycle and to refrigerate said cabinet during a refrigeration cycle, said air moving means comprising a first air circulation means for selectively propelling a primary refrigerated air band, and a secondary air circulation means for selectively propelling a second air guard band in the same direction as said primary air band during a refrigeration cycle; and said control means terminating operation of said second air circulation means and causing said primary air band to draw ambient air from outside said cabinet and to contact said low temperature element with said primary air band containing the ambient air during a defrost cycle of operation.

41. A display cabinet according to claim 40, wherein during a defrost cycle of operation said first air circulation means is caused to reverse the flow of said primary air band from the direction of flow of said air band during a refrigeration cycle of operation.

42. A display cabinet according to claim 40, wherein lighting means are included in said cabinet for illuminating said display space.

43. A display cabinet according to claim 30, including a primary air conduit arranged inside said cabinet about said display space for containing a primary refrigerated air band during a refrigeration cycle of operation, and a secondary air conduit arranged within said cabinet adjacent to a substantial portion of said primary air conduit, and said secondary air conduit connected at an inlet end thereof to said primary air conduit, said primary and said secondary conduits being separate along the length thereof and said secondary conduit inlet end to the outlet end thereof, and said cabinet including a common conduit inlet chamber for said primary refrigerated air band and said secondary air band flowing in said secondary air conduit.

44. A display cabinet according to claim 43, wherein during a refrigeration cycle of operation said air moving means propels said primary air band within said primary band conduit and through said common conduit inlet chamber and propels said secondary air band within said secondary air conduit and through said common conduit inlet chamber, and wherein during a defrost cycle of operation said air defrost means causes said air moving means to reverse the flow direction of said primary and said secondary air bands and to draw ambient air into said cabinet and into contact with said low temperature element for defrosting.

45. A display cabinet having a refrigeration means and a display space therein comprising: a cabinet having top, bottom, end and side walls and having aperture means in at least one wall thereof for communicating ambient outside air with the air in said cabinet, said aperture means comprising an access opening for permitting access to said display space; covering means for said aperture means including at least one barrier door for substantially covering said access opening, said door being movable for enabling access to products within said display space; at least one air conduit extending along said top, bottom, rear and side walls about said display space and having an outlet opening and an inlet opening at opposing ends thereof, said outlet opening and said inlet opening being arranged in aerodynamic alignment; an air band contained within said air conduit which upon leaving said outlet opening will be directed toward and received by said inlet opening to form an air curtain across said access opening along a path inside of said barrier door; said refrigeration means including a low temperature element; air moving means for circulating said air band within said air conduit and moving said air band into contact with said low temperature element during a refrigeration cycle of operation; air defrost means for selectively creating a gap between said barrier door and said access opening; said air defrost means causing said air moving means to pass ambient air through said cabinet and through said aperture means during a defrost cycle of operation to bring said ambient air into contact with said low temperature element to remove frost therefrom and to thereafter eject the defrost ambient air from said cabinet; control means for selectively operating said air defrost means and said refrigeration means to defrost said low temperature element during a defrost cycle and to refrigerate said cabinet during a refrigeration cycle; and said covering means including a plurality of barrier doors attached to said display cabinet for substantially covering said access opening, and wherein said air defrost means selectively creates a gap between at least alternate doors in the series of said barrier doors and said access opening during a defrost cycle of operation.

46. A display cabinet according to claim 45, wherein said air defrost means creates a gap between substantially all of said barrier doors and said access openings simultaneously.

47. A display cabinet according to claim 45, wherein said air defrost means comprises a series of door operating mechanisms arranged for individually and selectively creating a gap between each of said barrier doors and said access opening during a defrost cycle.

48. A display cabinet according to claim 45, wherein said air defrost means comprises a door operating mechanism for selectively creating a gap between at least alternate doors in the series of said barrier doors and said access opening.

49. A display cabinet according to claim 37, wherein said air moving means includes an auxiliary air circulation means for increasing ambient air in-flow into said display cabinet and for commingling the ambient air with said primary air band during a defrost cycle.

50. A display cabinet according to claim 37, wherein said air moving means is prevented from propelling said secondary air band during a defrost cycle of operation.

51. A display cabinet according to claim 37, wherein said air moving means propels said secondary air band only during portions of the refrigeration cycle in which said barrier door is open.

52. A display cabinet according to claim 51, wherein said control means contains sensing means for detecting the opening of said barrier door and wherein said control means operates said air moving means for propelling said secondary air band in the same direction as said primary refrigerated air band selectively in response to the opening of said barrier door in a refrigeration cycle.

53. A display cabinet according to claim 30, wherein said control means includes means for sensing the refrigeration condition within said display space and means for selectively operating said air moving means to propel said secondary air band in the same direction as said primary refrigerated air band depending upon the refrigeration condition sensed.

54. A display cabinet according to claim 30, wherein said barrier door contains therein a transparent material viewing port.

55. In a display cabinet having refrigeration means and a display space therein accessible through at least one access opening, at least one barrier door for substantially covering said access opening, and means for providing a plurality of air bands for selective circulation within said cabinet during a refrigeration cycle of operation to maintain a flow pattern inside of said cabinet adjacent to said barrier door, wherein at least one of said air bands is cooled by contact with said refrigeration means; the improvement comprising: air defrost means for selectively creating a gap between said barrier door and said access opening for enabling passage of ambient air at least into said air band in contact with said refrigeration means to remove frost therefrom during a defrost cycle of operation.

56. In a display cabinet having refrigeration means and a display space therein accessible through at least one access opening, at least one barrier door for substantially covering said access opening, and means for providing a plurality of air bands for selective circulation within said cabinet to maintain a flow pattern inside of said cabinet adjacent to said barrier door, wherein one of said air bands is a primary refrigerated air band circulated about said display space, and wherein another of said air bands is a secondary air guard band which is circulated about said primary air band within said cabinet, and wherein said primary refrigerated air band is cooled by contact with said refrigeration means; the improvement comprising: air defrost means for selectively creating a gap between said barrier door and said access opening for enabling passage of ambient air at least into said air band in contact with said refrigeration means to remove frost therefrom during a defrost cycle of operations.

57. In a display cabinet having refrigeration means and a display space therein accessible through at least one access opening, at least one barrier door for substantially covering said access opening, and means for providing a plurality of air bands for selective circulation within said cabinet during a refrigeration cycle of operation to maintain a flow pattern inside of said cabinet adjacent to said barrier door, wherein at least one of said air bands is cooled by contact with said refrigeration means; the improvement comprising: a first air band functioning as a primary refrigerated air band circulated about said display space, a secondary air guard band circulated about said primary air band within said said display cabinet, said primary air band and said secondary air guard band circulated within said display cabinet in the same direction during a refrigeration cycle, air defrost means for selectively creating a gap between barrier door and said access opening for enabling passage of ambient air at least into said primary air band in contact with said refrigeration means to remove frost therefrom during a defrost cycle of operation, said air defrost means enabling a reversal of the flow direction of said secondary air guard band during a defrost cycle, and including guide means provided for deflecting at least a portion of said secondary air guard band into said primary air band during a defrost cycle, and said air defrost means enabling ambient air to be drawn into the reversed direction secondary air band through a first portion of the gap between said barrier door and said access opening during a defrost cycle and to expel defrost embient air through a second portion of the gap.

58. The improvement according to claim 56, wherein at least one of said air bands is reversed during a defrost cycle of operation to draw ambient air into said display cabinet through a first portion of the gap between said barrier door and said access opening and to expel ambient defrost air from a second portion of the gap.

59. In a display cabinet having refrigeration means and a display space therein accessible through at least one access opening, at least one barrier door for substantially covering said access opening, and means for providing a plurality of air bands for selective circulation within said cabinet during a refrigeration cycle of operation to maintain a flow pattern inside of said cabinet adjacent to said barrier door, wherein at least one of said air bands is cooled by contact with said refrigeration means; the improvement comprising: a first air band functioning as a primary refrigerated air band circulated about said display space, a secondary air guard band circulated about said primary air band within said display cabinet, air defrost means for selectively creating a gap between said barrier door and said access opening for enabling passage of ambient air at least into said primary air band in contact with said refrigeration means to remove frost therefrom during a defrost cycle of operation, said air defrost means enabling the reversal of the flow direction of said primary refrigerated air band during a defrost cycle of operation to draw ambient air into said display cabinet through a first portion of the gap between said barrier door and said access opening and to expel ambient defrost air from a second portion of the gap, and said air defrost means enabling termination of the flow of said secondary air guard band during a defrost cycle.

60. In a display cabinet having refrigeration means and a display space therein accessible through at least one access opening, at least one barrier door for substantially covering said access opening, and means for providing a plurality of air bands for selective circulation within said cabinet during a refrigeration cycle of operation to mantain a flow pattern inside of said cabinet adjacent to said barrier door, wherein at least one of said air bands is cooled by contact with said refrigeration means; the improvement comprising: a first air band functioning as a primary refrigerated air band circulated about said display space, a secondary air guard band circulated about said primary air band within said display cabinet, air defrost means for selectively creating a gap between said barrier door and said access opening for enabling passage of ambient air at least into said primary air band in contact with said refrigeration means to remove frost therefrom during a defrost cycle of operation, at least one of said air bands being reversed during a defrost cycle of operation to draw ambient air into said display cabinet through a first portion of the gap between said barrier door and said access opening and to expel ambient defrost air from a second portion of the gap, and including air moving means for said primary and said secondary air guard bands for circulating said air bands in a first direction during a refrigeration cycle and in the opposite direction during a defrost cycle.

61. The improvement according to claim 56, wherein said secondary air guard band is circulated within said display cabinet only during portions of the refrigeration cycle in which said barrier door is open.

62. In a display cabinet having refrigeration means and a display space therein accessible through at least one access opening, at last one barrier door for substantially covering said access opening, and means for providing a plurality of air bands for selective circulation within said cabinet during a refrigeration cycle of operation to maintain a flow pattern inside of said cabinet adjacent to said barrier door, wherein at least one of said air bands is cooled by contact with said refrigeration; the improvement comprising: a first air band functioning as a primary refrigerated air band circulated about said display space, a secondary air guard band circulated about said primary air band within said display cabinet, air defrost means for selectively creating a gap between said barrier door and said access opening for enabling passage of ambient air at least into said primary air band in contact with said refrigeration means to remove frost therefrom during a defrost cycle of operation, and control means for detecting the opening of said barrier door and for operating an air moving means for propelling said secondary air guard band in the same direction as said primary refrigerated air band selectively in response to a predetermined number of openings of said barrier door in the refrigeration cycle.

63. In a display cabinet having refrigeration means and a display space therein accessible through at least one access opening, at least one barrier door for substantially covering said access opening, and means for providing a plurality of air bands for selective circulation within said cabinet during a refrigeration cycle of operation to maintain a flow pattern inside of said cabinet adjacent to said barrier door, wherein at least one of said air bands is cooled by contact with said refrigeration; the improvement comprising: a first air band functioning as a primary refrigerated air band circulated about said display space, a secondary air guard band circulated about said primary air band within said display cabinet, air defrost means for selectively creating a gap between said barrier door and said access opening for enabling passage of ambient air at least into said primary air band in contact with said refrigeration means to remove frost therefrom during a defrost cycle of operation, control means for sensing the refrigeration condition within said display space, air moving means for propelling said secondary air guard band in the same direction as said primary refrigerated air band depending upon the refrigeration condition sensed, and said control means including means for selectively operating said air moving means.

64. In a display cabinet having refrigeration means and a display space therein accessible through at least one access opening, a plurality of barrier doors attached to said cabinet for substantially covering said access opening, and means for providing a plurality of air bands for selective circulation within said cabinet to maintain a flow pattern inside of said cabinet adjacent to said barrier door, wherein at least one of said air bands is cooled by contact with said refrigeration means; the improvement comprising: air defrost means for selectively creating a gap between said barrier door and said access opening for enabling passage of ambient air at least into said air band in contact with said refrigeration means to remove frost therefrom during a defrost cycle of operation, said air defrost means enabling the selective creation of a gap between at least alternate doors in the plurality of doors and said access opening during a defrost cycle of operation.

65. The improvement according to claim 64, wherein said air defrost means creates a gap between substantially all of said barrier doors and said access opening.

66. The improvement according to claim 55, wherein said barrier door contains therein a transparent material viewing port.

67. The improvement according to claim 55, wherein a plurality of barrier doors are attached to said display cabinet for substantially covering a plurality of access openings and wherein said air defrost means comprises a series of door operating mechanisms arranged for individually and selectively creating a gap between each of said barrier doors and said access openings during a defrost cycle.

68. In a display cabinet having refrigeration means and a display space therein accessible through at least one access opening, a plurality of barrier doors attached to said display cabinet for substantially covering said access opening, and means for providing a plurality of air bands for selective circulation within said cabinet to maintain a flow pattern inside of said cabinet adjacent to said barrier door, wherein at least one of said air bands is cooled by contact with said refrigeration means; the improvement comprising: air defrost means for selectively creating a gap between said barrier doors and said access opening for enabling passage of ambient air at least into said air band in contact with said refrigeration means to remove frost therefrom during a defrost cycle of operation, said air defrost means comprising a door operating mechanism for selectively creating a gap between at least alternate doors of said plurality of doors and said access opening.

69. In a display cabinet having refrigeration means and a display space therein accessible for product storage and selection through an access opening, at least one barrier door for substantially covering said access opening, a first air circulation means for propelling a primary refrigerated air band within said display cabinet, a second air circulation means for selectively propelling a secondary air guard band in the same direction as said primary air band during a refrigeration cycle, a primary air conduit arranged inside said cabinet about said display space for containing said primary refrigerated air band, and a secondary air conduit arranged within said cabinet adjacent to said primary air conduit to the exterior side thereof for containing said secondary air guard band, said primary air band cooled by contact with said refrigeration means; the improvement comprising: an air defrost means for selectively creating a gap between said barrier door and said access opening for enabling passage of ambient air into said primary air conduit during a defrost cycle to propel the ambient air into contact with said refrigeration means to remove frost therefrom.

70. The improvement according to claim 69, wherein said first air circulation means reverses the direction of flow of said primary air band during a defrost cycle, and wherein said second air circulation means prevents circulation of said secondary air band during the defrost cycle of operation.

71. In a display cabinet having refrigeration means and a display space therein accessible for product storage and selection through an access opening, at least one barrier door for substantially covering said access opening, and an air moving means for circulating a primary air band and a secondary air guard band within said cabinet, said primary air band circulated in contact with said refrigeration means, said air movement means propelling said primary and said secondary air bands in a first direction during a refrigeration cycle and in the opposite direction in a defrost cycle, a primary air conduit arranged inside said cabinet about said display space for containing said primary air band, and a secondary air conduit arranged within said cabinet adjacent to a substantial portion of said primary air conduit, said secondary air conduit connected at an inlet end thereof to said primary air conduit, said primary and said secondary conduits being separated along the lengths thereof from said secondary conduit inlet to the outlet end thereof, and said cabinet including a common conduit inlet chamber for said primary air band and said secondary air band; the improvement comprising: air defrost means for selectively creating a gap between said barrier door and said access opening for enabling the passage of ambient air into at least said primary air band during a defrost cycle to bring the ambient air into contact with said refrigeration means to remove frost therefrom.

72. The improvement according to claim 71, wherein both of said primary air band and said secondary air band are propelled by said air moving means in the same direction during a refrigeration cycle and in the opposite direction during a defrost cycle of operation.

73. A method of operating a refrigerated display cabinet comprising a cabinet having a display space therein, and aperture means in at least one wall thereof for communicating ambient outside air with the air in the cabinet, the aperture means comprising an access opening for permitting products to be moved into and out of the display case, covering means for the aperture means including a barrier door for substantially covering the access opening, the barrier door being movable for enabling access to the cabinet, at least one air conduit extending about the display space and having an outlet opening and an inlet opening at opposite ends thereof, with the outlet opening and inlet opening being arranged in aerodynamic alignment so that air leaving the air conduit outlet opening will be directed toward the received by the inlet opening, and an air moving means for propelling a refrigerated air band through the air conduit during a refrigeration cycle and for propelling ambient air through the cabinet during a defrost cycle, and a refrigeration means arranged within the air conduit; the method comprising the steps of: selectively operating the display cabinet in a refrigeration cycle of operation and in a defrost cycle of operation; during a refrigeration cycle, circulating the air band through the air conduit so that air is expelled from the outlet opening and received by the inlet opening so as to form an air curtain across the access opening in the cabinet along a path inside of the barrier door, and propelling the air band through the refrigeration means; during a defrost cycle operation, terminating operation of the refrigeration means, causing ambient air to be drawn into the cabinet, pass through a substantial portion of the air conduit, and across the refrigeration means, causing the defrost ambient air to be ejected from the cabinet, and creating a gap between the barrier door and the access opening to enable ambient air throughflow; whereby ambient air is drawn into the air band and across the refrigeration means to defrost the same by communicating ambient air with the air band in the display cabinet.

74. A method according to claim 73, wherein the aperture means includes an air passage port in a wall of the cabinet including the additional step of causing ambient air to move through the cabinet by propelling ambient air through the air passage port and through the gap between the barrier door and the access opening during a defrost cycle.

75. A method according to claim 73, wherein the aperture means includes an air passage port in a wall of the cabinet, and including the additional steps of causing ambient air to be drawn into the air conduit through the air passage port and to thereafter pass through the refrigeration means and to be ejected from the display cabinet through the gap between the barrier door and the access opening during a defrost cycle.

76. A method according to claim 73, wherein the aperture means includes an air passage port in a wall of the cabinet, and including the additional steps of causing ambient air to be drawn into the air conduit through the gap between the barrier door and the access opening during a defrost cycle and to thereafter pass through the refrigeration means and to be ejected from the display cabinet through the air passage port.

77. A method according to claim 73, wherein the air conduit is a primary conduit containing a primary refrigerated air band during a refrigeration cycle and wherein a secondary air conduit is provided for containing a secondary air guard band propelled by the air moving means in the same direction as the primary air band during the refrigeration cycle; including the additional step of terminating movement of the secondary air band during the defrost cycle.

78. A method according to claim 73, wherein the air conduit is a primary air conduit containing a primary refrigerated air band during a refrigeration cycle and wherein a secondary air conduit is provided for containing a secondary air guard band propelled by the air moving means in the same direction as the primary air band during the refrigeration cycle; including the additional steps of: during a defrost cycle of operation reversing the flow direction of the primary and secondary air bands, causing ambient air to be preferentially drawn into the primary air band and passed through the refrigeration means, and thereafter ejecting the defrost ambient air from the cabinet through the gap between the barrier door and the access door.

79. A method according to claim 73, wherein the air conduit is a primary conduit containing a primary refrigerated air band during a refrigeration cycle and including a secondary air conduit containing a secondary air guard band propelled by the air moving means in the same direction as the primary air band during the refrigeration cycle, the secondary air conduit having an air guidance means arranged therein for deflecting at least a portion of the flow of the secondary air band into the primary air conduit during a defrost cycle of operation; including the additional steps of: reversing the flow direction of the secondary air band, causing ambient air to be preferentially drawn into the secondary air band through the gap between the barrier door and the access opening during a defrost cycle, passing the secondary air band containing the ambient air through the refrigeration means to defrost the same, and to thereafter eject the defrost ambient air from the cabinet through the gap between the barrier door and the access door.

80. A method according to claim 73, wherein the air conduit is a primary conduit containing a primary refrigerated air band propelled by a first air circulation means during a refrigeration cycle, and including a secondary air conduit containing a secondary air guard band propelled by a secondary air circulation means in the same direction as the primary air band during the refrigeration cycle, including the additional steps of: terminating operation of said second air circulation means during the defrost cycle, and reversing the flow direction of the first air circulation means to draw ambient air into the cabinet through a top portion between the gap between the barrier door and the access opening and to eject the defrost ambient air from a lower portion of the gap during the defrost cycle of operation.

81. A method according to claim 73, wherein the air conduit is a primary conduit containing a primary refrigerated air band during a refrigeration cycle and wherein a secondary air conduit is provided for containing a secondary air guard band propelled by th air moving means in the same direction as the primary air band during the refrigeration cycle; including the additional step of preventing movement of the secondary air band during portions of the refrigeration cycle in which the barrier door is not opened.

82. A method according to claim 73, wherein the air conduit is a primary conduit containing a primary refrigerated air band during a refrigeration cycle and wherein a secondary air conduit is provided for containing a secondary air guard band propelled by the air moving means in the same direction as the primary air band during the refrigeration cycle; including the additional steps of detecting the opening of the barrier door, and controlling the propulsion of the secondary air band selectively in response to the opening of the barrier door during a refrigeration cycle.

83. A method according to claim 73, wherein the air conduit is a primary conduit containing a primary refrigerated air band during a refrigeration cycle and wherein a secondary air conduit is provided for containing a secondary air guard band propelled by the air moving means in the same direction as the primary air band during the refrigeration cycle; including the additional steps of sensing the refrigeration condition within the display space in the cabinet, and selectively propelling the secondary air band in the same direction as the primary refrigerated air band in response to the refrigeration condition.

84. A method according to claim 73, wherein the air conduit is a primary conduit containing a primary refrigerated air band during a refrigeration cycle and wherein a secondary air conduit is provided for containing a secondary air guard band propelled by the air moving means in the same direction as the primary air band during the refrigeration cycle; including the additional steps of detecting openings of the barrier door, and controlling propulsion of the secondary air band in the same direction as the primary refrigerated air band selectively in response to a predetermined number of the openings of the barrier door during a refrigeration cycle.

85. A method of operating a refrigerated display cabinet having a cabinet containing a display space therein, and aperture means comprising an access opening in at least one wall thereof for communicating ambient outside air with the air in the cabinet and for permitting access to the display space, covering means for the aperture means including a barrier door for substantially covering the access opening, the barrier door being movable for enabling access to the cabinet, a primary air conduit extending about the display space and having an outlet opening and an inlet opening at opposite ends thereof, with the outlet opening and the inlet opening being arranged in aerodynamic alignment so that air leaving the primary air conduit outlet opening will be directed toward and received by the inlet opening; a refrigeration means arranged within the primary air conduit; and a secondary air conduit extending about a substantial portion of said primary conduit and having a secondary outlet opening and a secondary inlet opening at opposite ends thereof; the method comprising the steps of: selectively operating the display cabinet in a refrigeration cycle of operation and a defrost cycle of operation; during a refrigeration cycle of operation, circulating a primary air band through the primary air conduit so that air is propelled through the primary outlet opening and received by the primary inlet opening so as to form an air curtain across the access opening in the cabinet along a path inside of the barrier door; propelling the primary air band through the refrigeration means; during the refrigeration cycle of operation, circulating a secondary air band through the secondary air conduit in the same direction as the primary air band so that air is propelled through the secondary outlet opening and received by the secondary inlet opening so as to form a secondary air guard curtain across the access opening in the display cabinet along a path inside of the barrier door; during a defrost cycle of operation, causing ambient air to be drawn into the cabinet and to pass across the refrigeration means and through the primary air conduit and be expelled from the display cabinet, creating a gap between the barrier door and the access opening, to enable ambient air through-flow; whereby ambient air is thereby drawn into the cabinet and across the refrigeration means to defrost the same by communicating ambient air with the cabinet.

86. A method according to claim 85, wherein the aperture means includes an air passage port in a wall of the cabinet for communicating with the primary air conduit and including the additional step of: causing ambient air to be moved through the cabinet by moving ambient air through the air passage port and through the gap between the barrier door and the access opening during a defrost cycle.

87. A method according to claim 86, including the additional step of: terminating circulation of the secondary air band during a defrost cycle of operation.

88. A method according to claim 85, including the additional step of: causing ambient air to be drawn into the primary air conduit through a first portion of the gap between the barrier door and the access opening, and to thereafter pass across the refrigeration means and to thereafter be ejected through a second portion of the gap during a defrost cycle.

89. A method according to claim 85, wherein the curtain of refrigerated air extends in a substantially vertical direction across the access opening in the cabinet.

90. A method according to claim 85, wherein the air flow through the secondary air conduit during the defrost cycle of operation is in a direction opposite the direction of air flow in the secondary air conduit during a refrigeration cycle of operation.

91. A method according to claim 90, wherein the quantity of air flowing through the secondary air conduit during a defrost cycle of operation is 25–50% greater than the air flow in the secondary air conduit during the refrigeration cycle of operation.

92. The improvement according to claim 55, wherein a heater element is positioned adjacent to said refrigeration means to increase the temperature of the ambient air prior to contact with said refrigeration means.

* * * * *

UNITED STATES PATENT AND TRADEMARK OFFICE

CERTIFICATE OF CORRECTION

PATENT NO. : 4,369,632

DATED : January 25, 1983

INVENTOR(S) : Fayez F. Ibrahim

It is certified that error appears in the above-identified patent and that said Letters Patent is hereby corrected as shown below:

Please change the name of the inventor on the Cover page from "Fayez F. Abraham" in both occurences to -- Fayez F. Ibrahim --.

Column 6, line 4 "are should be -- as --.

Column 9, line 36 "it" should be -- is --.

Column 11, line 8, first occurence of "is" should be -- as --.

Column 11, line 55, "wall 16" should be -- top wall 16 --.

Column 13, line 26, "traversely" should be -- transversely --.

Column 14, line 17, "desired" should have a -- , -- after it.

Column 15, line 56, "wall 16" should be -- top wall 16 --.

Column 16, line 35, "top cabinet" should be -- top of cabinet --.

Column 17, line 34, "18" should be -- 318 --.

UNITED STATES PATENT AND TRADEMARK OFFICE

CERTIFICATE OF CORRECTION

PATENT NO. : 4,369,632

DATED : January 25, 1983

INVENTOR(S) : Fayez F. Ibrahim

It is certified that error appears in the above-identified patent and that said Letters Patent is hereby corrected as shown below:

Column 18, line 1, "condensor" should be -- condenser --.

Column 18, line 12, "334" should be -- 324 --.

Column 19, line 35, "condensor" should be -- condenser --.

Column 23, line 1, "claim 14" should be -- claim 19 --.

Column 23, line 8, "claim 14" should be -- clain 19 --.

Column 23, line 12, "claim 14" should be -- claim 19 --.

Column 23, line 15, "comingling" should be -- commingling --.

Column 26, line 57, "co-mingle" should be -- commingle --.

Column 30, line 12, delete first occurence of "said".

Column 30, line 29, "embient" should be -- ambient --.

Column 31, line 30, "last" should be -- least --.

UNITED STATES PATENT AND TRADEMARK OFFICE

CERTIFICATE OF CORRECTION

PATENT NO. : 4,369,632

DATED : January 25, 1983

INVENTOR(S) : Fayez F. Ibrahim

It is certified that error appears in the above-identified patent and that said Letters Patent is hereby corrected as shown below:

Column 33, line 67, "the" first occurrence should be --and --.

Column 35, line 42, "th " should be -- the --.

Signed and Sealed this

*Twenty-fourth* Day of *July 1984*

[SEAL]

*Attest:*

GERALD J. MOSSINGHOFF

*Attesting Officer*

*Commissioner of Patents and Trademarks*